United States Patent [19]

Atwell

[11] 4,269,927

[45] May 26, 1981

[54] INTERNALLY DOPED SURFACE SENSITIZED HIGH CHLORIDE SILVER HALIDE EMULSIONS AND PHOTOGRAHIC ELEMENTS AND PROCESSES FOR THEIR PREPARATION

[75] Inventor: Robert E. Atwell, Spencerport, N.Y.

[73] Assignee: Eastman Kodak Company, Rochester, N.Y.

[21] Appl. No.: 169,241

[22] Filed: Jul. 16, 1980

Related U.S. Application Data

[63] Continuation-in-part of Ser. No. 27,325, Apr. 25, 1979, abandoned.

[51] Int. Cl.[3] ..... G03C 1/28

[52] U.S. Cl. ..... 430/217; 430/603; 430/604; 430/605; 430/538; 430/567; 430/503; 430/599; 430/569

[58] Field of Search ..... 430/604, 599, 217, 503, 430/523, 538, 567, 605, 569, 217, 603, 505

[56] References Cited

U.S. PATENT DOCUMENTS

| | | | |
|---|---|---|---|
| 2,146,802 | 2/1939 | Dersch | 430/604 |
| 2,950,972 | 8/1960 | Mueller et al. | 430/604 |
| 3,033,682 | 5/1962 | Hunt | 430/604 |
| 3,047,392 | 7/1962 | Scott | 430/604 |
| 3,287,136 | 11/1966 | McBride | 430/569 |
| 3,531,289 | 9/1970 | Wood | 430/605 |
| 3,615,614 | 10/1971 | Krohn et al. | 430/599 |
| 3,660,100 | 5/1972 | Heeks et al. | 430/599 |
| 3,709,692 | 1/1973 | Haase et al. | 430/604 |
| 3,761,267 | 9/1973 | Gilman et al. | 430/604 |
| 3,901,711 | 8/1975 | Iwaosa et al. | 430/608 |
| 3,979,213 | 9/1976 | Gilman et al. | 430/604 |

FOREIGN PATENT DOCUMENTS

| | | | |
|---|---|---|---|
| 1121496 | 11/1964 | United Kingdom | 430/604 |

*Primary Examiner*—Won H. Louie, Jr.
*Attorney, Agent, or Firm*—Carl O. Thomas

[57] ABSTRACT

This disclosure relates to high chloride silver halide emulsions and photographic elements containing silver halide grains which are internally doped with cadmium, lead, zinc or mixtures thereof in concentrations up to $7\times10^{-5}$ mole/mole of silver halide.

35 Claims, 3 Drawing Figures

INTERNALLY DOPED SURFACE SENSITIZED HIGH CHLORIDE SILVER HALIDE EMULSIONS AND PHOTOGRAHIC ELEMENTS AND PROCESSES FOR THEIR PREPARATION

CROSS-REFERENCE TO RELATED APPLICATION(S)

This is a continuation-in-part of Ser. No. 027,325, filed Apr. 25, 1979, now abandoned.

FIELD OF THE INVENTION

This invention is directed to improved photographic elements of the developing out type, to high chloride silver halide emulsions and to methods of preparing such emulsions.

SUMMARY OF THE INVENTION AND STATE-OF-THE-ART

The overwhelming majority of radiation-sensitive silver halide emulsions and photographic elements are light-sensitive, and of the developing out type. That is, the emulsions and elements are rendered developable in areas where imagewise exposure to light occurs and are contacted with a developer solution to produce a visible image. Silver bromide and silver bromoiodide emulsions have been preferentially used for higher speed imaging applications.

As compared with silver bromide and silver bromoiodide, high chloride silver halide emulsions and photographic elements of the developing out type offer distinct advantages in a number of respects. For example, silver chloride possesses less native sensitivity in the visible region of the spectrum than silver bromide, thereby permitting yellow filter layers to be omitted from multicolor photographic elements. Further, high chloride silver halides are more soluble than silver bromide and silver bromoiodide, thereby permitting development to be achieved in shorter times. Unfortunately these advantages of high chloride silver halides have frequently not been realized in higher speed imaging applications, since the relatively higher speeds of silver bromide and silver bromoiodide have dictated their use.

This invention satisfies a long standing need in the art in providing high chloride silver halide emulsions and photographic elements of the developing out type of increased photographic speed. It has been discovered that the speed of high chloride silver halide emulsions and photographic elements of the developing out type can be unexpectedly increased by doping silver halide grains which are at least 80 mole percent silver chloride, based on total silver halide, with very low concentrations of certain divalent metals. This discovery is surprising not only because of the increased photographic speeds obtained, but also because extensive prior investigations of divalent metal dopants for silver halide grains by those skilled in the art have failed to identify these advantageous emulsions and photographic elements and have impliedly and, in some instances, explicitly taught away from this discovery.

The recognized utility for incorporating divalent metals in silver chloride containing photographic elements has been largely directed to comparatively specialized, nondeveloping out applications using substantially higher concentrations of the divalent metals than herein employed. For example, the most extensive use of divalent metal dopants in negative-working silver chloride emulsions has occurred in printout and direct-print photographic elements. Printout photographic elements produce a negative visible image directly upon imagewise exposure without the use of a developer. Direct-print emulsions employ a high intensity imagewise exposure followed by uniform exposure to lower intensity light; e.g., ambient lighting, to provide a visible negative image. Illustrative patents disclosing divalent metal doped silver chloride emulsions useful in printout and direct-print photographic elements as well as divalent metal concentrations are set forth below in Table I.

TABLE I

| U.S. Pat. No. | Divalent Metal | Conc. (Mole %) |
|---|---|---|
| 3,033,682 (Hunt) | Pb | 0.1-25 |
| 3,047,392 (Scott) | Cd | 0.65-25 |
| | Pb | 0.35-6.9 |
| 3,287,136 (McBride) | Pb | 0.01-1 |
| 3,615,614 (Krohn et al) | Cu | 0.03-15 |
| | Pb | 0.07-50 |
| 3,660,100 (Heeks et al) | Pb | 0.05-15 |

In still a more specialized application Haase et al U.S. Pat. No. 3,709,692 teaches to use large monocrystals of silver chloride as radiation particle track detectors. The silver chloride monocrystals contain $3.5\times10^{-4}$ to $7\times10^{-3}$ mole percent lead and $2.5\times10^{-3}$ to 1.4 mole percent cadmium. The monocrystals are flashed with high intensity light to produce a visible track.

It has been reported and demonstrated that the use of divalent metal ions in negative-working silver halide emulsions of the developing out type has the effect of decreasing the sensitivity of the emulsions to ambient light. Mueller et al U.S. Pat. No. 2,950,972 teaches to incorporate cadmium ions in silver bromide and silver bromoiodide emulsions in concentrations of at least $1\times10^{-3}$ mole percent for the purpose of increasing X-ray and gamma sensitivity of the emulsion. Mueller et al teaches that these small amounts of cadmium have the effect of producing a marked decrease in the sensitivity of the emulsions to visible light. This effect is demonstrated with a 30 mole percent bromide silver bromochloroiodide emulsion by Iwaosa et al U.S. Pat. No. 3,901,711. In Example 2 a silver bromochloroiodide emulsion containing 30 mole percent bromide and a slight amount of silver iodide is treated with strontium chloride as a metal dopant and various combinations of gold chloride and polyethylene glycol. The effect of the strontium chloride is to reduce the sensitivity of low intensity exposures of emulsions I and J as compared respectively with otherwise similar emulsions G and H. Iwaosa et al teaches the use of cadmium, zinc or lead compounds in combination with gold salts and polyalkylene oxides in order to avoid undesirable high intensity reciprocity failure. Assuming lead chloride to be employed as a divalent melt salt, this requires a minimum of $3.6\times10^{-3}$ mole percent lead to be present in the emulsion. Cadmium and zinc, being of lower molecular weight, would be present in even higher molar concentrations.

Halwig U.K. Pat. No. 1,121,496 teaches to obtain higher printing speeds and wider exposure latitudes for silver chlorobromide emulsions containing at least 50 mole percent chloride by incorporating at least 0.1 gram of divalent cadmium per mole of silver halide (i.e., $8.9\times10^{-2}$ mole percent cadmium per mole of silver halide). Halwig avoids the lower divalent metal ion concentration levels taught by Mueller et al and demonstrated by Iwaosa et al to desensitize silver bromide, silver bromoiodide and 30 mole percent silver bromide silver bromochloroiodide emulsions.

In one aspect this invention is directed to a silver halide emulsion of the developing out type comprised of sensitized silver halide grains which are at least 80 mole percent silver chloride and less than 5 mole percent silver iodide, based on total silver halide. The silver halide grains are internally doped with cadmium, lead, copper, zinc or mixtures thereof in a speed increasing amount of up to $7\times10^{-5}$ mole per mole of silver halide.

In another aspect this invention is directed to a photographic element of the developing out type comprised of a support and, coated on the support, a silver halide emulsion layer comprised of an emulsion as described above.

In an additional aspect this invention is directed to a process of forming a silver halide emulsion of the developing out type by reacting a water soluble silver salt with one or more water soluble halide salts in an aqueous medium containing a peptizer to form radiation-sensitive silver halide grains and surface chemically sensitizing the silver halide grains with a gold sensitizer. This process is characterized by the improvement comprising forming silver halide grains which are at least 80 mole percent silver chloride and less than 5 mole percent silver iodide, based on total silver halide, and introducing into the aqueous medium during formation of the silver halide grains cadmium, lead, copper, zinc or mixtures thereof, in a total concentration of from $2\times10^{-6}$ to $7\times10^{-5}$ mole per mole of silver.

It has been discovered quite surprisingly that the high chloride silver halide emulsions and photographic elements containing low concentrations of certain divalent metal ion dopants as described above exhibit increased photographic speeds. Thus, such emulsions and photographic elements offer the art recognized advantages attributable to high chloride silver halide emulsions while achieving photographic speeds more commonly associated with silver bromide and silver bromoiodide photographic emulsions. The fact that the inclusion of low concentrations of divalent metal ions of the type identified above can increase photographic speeds of these emulsions and photographic elements is, of course, surprising in view of the teachings in the art that low concentration levels of similar divalent metal ion dopants have the effect of desensitizing silver halide emulsions of higher bromide concentration to visible light. By contrast, the sensitivity advantages of the emulsions and photographic elements of this invention can be realized under the exposure conditions of candid photography (that is, including low intensity and available light exposure conditions). Finally, the present improvement in sensitivity has been surprisingly demonstrated to be a function of the halide content of the silver halide grains. Specifically, it has been observed that the improvement in sensitivity is highest for silver chloride, silver chlorobromides of at least 80 mole percent chloride, based on total silver halide, and silver chloroiodides of less than 5 mole percent iodide, based on total silver halide, and that comparable speed improvements have not been realized with silver halide grains of higher silver bromide or iodide content.

The advantages and features of the present invention can be better appreciated by reference to the following detailed description directed to certain preferred embodiments considered in conjunction with the drawings, in which FIG. 1 is a plot of dopant level in mg per mole of silver versus relative speed and FIGS. 2 and 3 are plots of percent increase in relative speed versus mole percent silver bromide and silver iodide, respectively.

DESCRIPTION OF PREFERRED EMBODIMENTS

Figure 1:
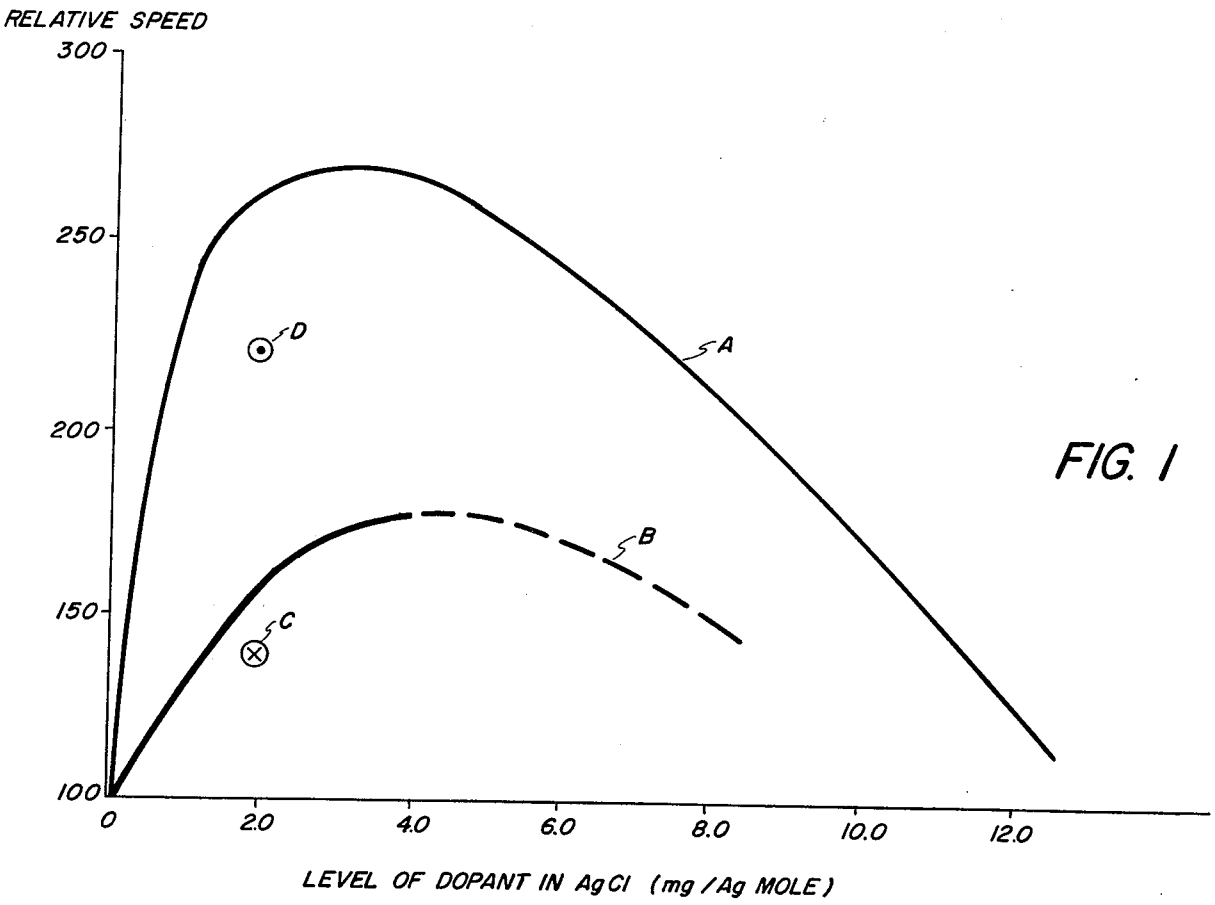

The silver halide emulsions of the present invention are comprised of silver halide grains which are at least 80 mole percent silver chloride and less than 5 mole percent silver iodide, based on total silver halide. In one preferred form the silver halide grains consist essentially of silver chloride. Because the solubility product constant of silver chloride is orders of magnitude higher than that of silver bromide or silver iodide, it is recognized that formation, ripening or extended holding of silver chloride grains in the presence of bromide and/or iodide ions will result in the inclusion of silver bromide and/or silver iodide in the silver chloride grains. The preferred silver halide grains are those which are at least 90 mole percent silver chloride. The remaining silver halide, if any, present in the silver halide grains can be silver bromide, silver iodide or some combination of the two. Silver bromide can be present in concentrations of up to 20 mole percent, preferably up to 15 mole percent, based on total silver halide. Silver iodide can be present in concentrations of less than 5 mole percent, preferably less than 2 mole percent, based on total silver halide. These silver halide grains are herein referred to as high chloride silver halide grains.

The high chloride silver halide grains contain a speed increasing amount of a metal dopant. The metal dopant can be cadmium, lead, copper, zinc or a combination of these elements in any proportion. While the metal dopants have the effect of increasing the sensitivity of surface chemically sensitized high chloride silver halide grains at concentrations up to and including $7\times10^{-5}$ mole per mole of silver halide, if the concentration levels are extended upwardly, the effect is to desensitize the emulsions. Significant improvements in the sensitivity of surface chemically sensitized emulsions have been observed when the metal dopants are introduced in concentrations in the range of from $2\times10^{-6}$ to $7\times10^{-5}$ mole per mole of silver halide during formation of the high chloride silver halide grains.

While cadmium, lead, zinc and copper internal dopants produce qualitatively similar effects in increasing the speed of surface chemically sensitized high chloride to silver halide emulsions, these elements differ in the degree to which they are capable of sensitizing the emulsions. Cadmium produces emulsions of the highest attainable sensitivities followed in effectiveness by zinc, lead and copper in that order. To form emulsions of the highest attainable sensitivities it is preferred to employ cadmium, zinc or combinations of these elements in concentrations of from $3\times10^{-6}$ to $6\times10^{-5}$, optimally $5\times10^{-6}$ to $2.5\times10^{-5}$, mole per mole of silver halide during formation of the high chloride silver halide grains. For emulsions of the highest attainable sensitivities using lead, copper or combinations of these elements as dopants, it is preferred to provide concentrations in the range of from $3\times10^{-6}$ to $5\times10^{-5}$, optimally from $8\times10^{-6}$ to $2\times10^{-5}$, mole per mole of silver halide during formation of the high chloride silver halide grains.

Radiation-sensitive silver halide emulsions are conventionally formed by reacting a water soluble silver salt with one or more water soluble halide salts in an aqueous medium containing a peptizer. The choice and proportion of halide salts controls the halide content of the silver halide grains formed. The peptizer maintains the silver halide grains in dispersion. Where a metal dopant is intended to be introduced into the silver halide grains, it can be introduced in any convenient manner, typically separately or with one of the silver or halide salts or the peptizer, in the form of a salt which is water soluble in its contemplated concentration ranges. By regulating the compositions and rates of addition of halide and divalent metal salts, emulsions containing the internally doped high chloride silver halide grains described above can be produced by otherwise conventional techniques, such as the double and single jet precipitation techniques described by Mueller et al U.S. Pat. No. 2,950,972, Iwaosa et al U.S. Pat. No. 3,901,711 and Halwig U.K. Pat. No. 1,121,496, the disclosures of which are here incorporated by reference.

In one preferred embodiment emulsions containing the internally doped high chloride silver halide grains described above are formed by a double jet precipitation technique using accelerated flow rates to produce relatively monodispersed, cubic grains. As employed herein, the term "monodispersed" indicates that at least 95 percent, by weight or by number, of the silver halide grains are within 40 percent of their mean effective diameter. In a specifically preferred form at least 95 percent, by weight or by number, of the silver halide grains are within 25 percent of the mean effective diameter, optimally within 10 percent of the mean effective diameter. The term "effective diameter" is herein employed as the diameter of the circle corresponding in area to the area subtended by a silver halide grain as viewed through a microscope or in a photomicrograph. The measurement of silver halide grain sizes is discussed further in Mees and James, *The Theory of the Photographic Process,* 3rd Ed., Macmillan, 1966, pp. 36–43.

In double jet precipitations a silver salt, such as silver nitrate, and a chloride salt, optionally employed in combination with a bromide and/or iodide salt, such as one or more chloride or other halide salts of an alkali or alkaline earth metal (e.g., sodium, potassium, magnesium or calcium), each in the form of an aqueous salt solution, are concurrently and separately introduced into the reaction vessel. An aqueous dispersing medium is present in the reaction vessel prior to the introduction of the aqueous halide and silver salt solutions. The presence of the dispersing medium along with agitation, in most instances, facilitates uniform blending of the aqueous halide and silver salt solutions while avoiding localized concentration gradients. Typically a dispersing medium volume is initially present in the reaction vessel which is from about 10 to 90 percent, preferably 20 to 80 percent, that of the silver halide emulsion to be formed. The dispersing medium is conventionally water or a dispersion of peptizer in water, optionally containing other ingredients, such as one or more silver halide ripening agents, more specifically described below. Preferably peptizer in a concentration of at least 10 percent, most preferably 20 percent, of the total weight of the vehicle present in the finished emulsion is initially present in the dispersing medium within the reaction vessel. Where the peptizer is not initially entirely present in the dispersing medium, the balance of the peptizer is preferably added during addition of the silver and halide salts. A minor portion of one of the silver or halide salt solutions, typically less than about 10 percent, is also initially present in the reaction vessel to adjust the pAg (log reciprocal silver ion concentration) of the reaction vessel contents at the outset of silver halide precipitation.

During the initial introduction of the aqueous silver and halide salt solutions into the reaction vessel the dissolved silver salt reacts with dissolved halide salt to form silver halide crystals. This initial phase of silver halide emulsion formation in which new silver halide crystals are being formed is referred to as nucleation. During subsequent addition of silver and halide salts, additional silver halide formed as a reaction product can be precipitated onto these nuclei, causing the mean size of the silver halide to increase and ultimately resulting in silver halide grains of the desired mean effective diameter.

Although additional silver halide grain formation can occur after the initial formation of silver halide nuclei, by controlling the rate of addition of silver and halide salts continued silver halide precipitation onto the originally formed silver halide nuclei can be achieved. This has the effect of producing a population of silver halide grains of similar size; i.e., monodispersed silver halide emulsions. Techniques are known in the art which achieve shortened silver halide precipitation times by permitting accelerated rates of addition of silver and halide salts. Such techniques are disclosed, for example, by Wilgus German No. OLS 2,107,118 and Kurz U.S. Pat. No. 3,672,900, the disclosures of which are here incorporated by reference.

Single jet silver halide precipitation is specifically contemplated as an alternative to double jet precipitation. In single jet precipitation substantially the entire halide salt solution is present in the reation vessel prior to introduction of the silver salt solution. The silver halide grains which are formed are polydispered; that is, they vary significantly in size and do not satisfy the grain size distribution requirements set forth above for monodispersed silver halide emulsions. Except for these differences the preferred aspects of double jet silver halide precipitation techniques described above are also applicable to single jet precipitation techniques.

In both the single jet and double jet precipitation techniques the speed increasing divalent metal salts, typically metal halides (e.g., cadmium, lead, copper and zinc chlorides), can be introduced into the reaction vessel at any time before introduction of at least 85 percent, most preferably 75 percent, of the silver salt solution has been completed. The speed increasing divalent metal salts are preferably dissolved in water or other suitable solvent prior to addition to the reaction vessel. The solution containing the speed increasing divalent metal salt typically comprises from about 1 to 10 percent by weight of the dispesing medium of the emulsion, the proportions being merely a matter of choice and convenience.

The individual reactants can be added to the reaction vessel through surface or sub-surface delivery tubes by gravity feed or by delivery apparatus for maintaining control of the rate of delivery and the pH and/or pAg of the reaction vessel contents, as illustrated by Culhane et al U.S. Pat. No. 3,821,002, Oliver U.S. Pat. No. 3,031,304 and Claes et al, *Photographische Korrespondenz,* 102 Band, Number 10, 1967, p. 162. In order to obtain rapid distribution of the reactants within the reaction vessel, specially contructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Saito et al German OLS 2,556,885 and Saito et al German OLS No. 2,555,364. An enclosed reaction vessel can be employed to recieve and mix reactants upstream of the main reaction vessel, as illustrated by Forster et al U.S. Pat. No. 3,897,935 and Posse et al U.S. Pat. No. 3,790,386.

The initially formed silver halide grains (i.e., silver halide nuclei) are sufficiently small that they can be dispersed by water alone. Thus, it is unnecessary to have any peptizer initially in the reaction vessel, although it is frequently convenient to have the peptizer at least partially present in the reaction vessel prior to initiating introduction of the silver and halide salts. Peptizer can be added to the reaction vessel with the halide salt, the silver salt or both and/or independently of both. While peptizer concentrations from 0.2 to about 10 percent by weight, based on the total liquid or emulsion weight in the reaction vessel, can be employed, it is preferred to keep the concentration of the peptizer in the reaction vessel prior to and during silver halide formation below about 6 percent by weight, based on the total weight. It is common practice to maintain the concentration of the peptizer in the reaction vessel in the range of from about 2 to 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 300 grams per mole of silver halide. Preferably the concentration of vehicle in the finished emulsion is below 50 grams per mole of silver halide. When coated and dried in forming a photographic element the vehicle preferably forms about 30 to 70 percent by weight of the emulsion layer.

Vehicles (which include both binders are peptizers) can be chosen from among those conventionally employed in silver halide emulsions. Preferred peptizers are hydrophilic colloids, which can be employed alone or in combination with hydrophobic materials. Suitable hydrophilic materials include both naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like as described in Yutzy et al U.S. Pat. Nos. 2,614,928 and 2,614,929, Lowe et al U.S. Pat. Nos. 2,691,582, 2,614,930, 2,614,931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, U.K. Pat. No. 1,489,080 and Hori et al Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Other materials commonly employed in combination with hydrophilic colloid peptizers as vehicles including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, 2,276,323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and 808,228, Wood U.K. Pat. No. 822,192 and Iguchi et al U.K. Pat. No. 1,398,055. These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the eulsion layers of the photographic elements of this invention, but also in other layers, such as overcoat layers, interlayers and layers positioned beneath the emulsion layers.

Although not required for the practice of this process, it is preferred that a silver halide ripening agent be present within the reaction vessel during silver halide formation. The ripening agent can be entirely contained within the dispersing medium in the reaction vessel before silver and halide salt addition, or it can be introduced into the reaction vessel along with one or more of the halide salt, silver salt or peptizer. In still another variant the ripening agent can be introduced independently during halide and silver salt additions.

Sulfur containing ripening agents are generally preferred. Conventional thioether ripening agents, such as those disclosed in McBride U.S. Pat. No. 3,271,157, here incorporated by reference, can be employed. Sufficient thioether ripening agent is employed to provide concentrations of from 0.05 to 50 grams, preferably about 0.1 to 20 grams, per mole of silver halide, based on the weight of silver.

Certain of the preferred organic thioether silver halide solvents can be represented by the formulas:

$$Q-[(CH_2)_r-CH_2-S-(CH_2)_2-X-(R)_p-(CH_2)_2-(R')_q-S-CH_2(CH_2)_m-Z]_n$$

and $$Q-(CH_2)_m-(CH_2-S-(CH_2)_n-S-CH_2(CH_2)_r-Z$$

wherein:

r and m are integers of 0 to 4; n is an integer of 1 to 4; p and q are integers of 0 to 3; X is an oxygen atom (—O—), a sulfur atom (—S—), a carbamyl radical $$(-\overset{O}{\overset{\|}{C}}NH-),$$

a carbonyl radical $$(-\overset{O}{\overset{\|}{C}}-) \text{ or}$$

a carboxy radical $$(-\overset{O}{\overset{\|}{C}}OH);$$

R and R′ are ethylene oxide radicals (—O—$CH_2CH_2$—); Q and Z are hydroxy radicals (—OH), carboxy radicals, or alkoxy radicals (—O—alkyl) wherein the alkyl group has 1 to 5 carbon atoms; and Q and Z can also be substituents described for X linked to form a cyclic compound.

Preferred organic thioether silver halide ripening agents suitable for forming the emulsions of the invention include compounds represented by the formulas:

$$HO(-R^2-S-)_rR^2OH,$$
$$(HO-R^2-S-R^2-O-R^4)_2,$$
$$R^3-O-R^2-S-R^2-\overset{O}{\overset{\|}{C}}NH-R^4-)_2,$$
$$(R^3-O-R^2-S-R^2-)_2S,$$
$$(R^3-NH\overset{O}{\overset{\|}{C}}-R^2-S-R^2-)_2O \text{ and}$$

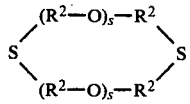

wherein: r is an integer of 1 to 3; s is an integer of 1 to 2; $R^2$ is an alkylene radical having 1 to 5 carbon atoms and is preferably ethylene (—$CH_2CH_2$—); $R^3$ is an alkyl radical having 1 to 5 carbon atoms and is preferably ethyl; and $R^4$ is an alkylene radical having 1 to 5 carbon atoms and is preferably methylene (—$CH_2$—).

As an alternative to thioether ripening agents, thiocyanate salts can be used, such as alkali metal, most commonly potassium, and ammonium thiocyanate salts. While any conventional quantity of the thiocyanate salts can be introduced, preferred concentrations are generally from about 0.1 to 20 grams of thiocyanate salt per mole of silver halide, based on the weight of silver. Illustrative prior teachings of employing thiocyanate ripening agents are found in Nietz and Russell, U.S. Pat. No. 2,222,264, cited above; Lowe et al U.S. Pat. No. 2,448,534, issued Sept. 7, 1948; and Illingsworth U.S. Pat. No. 3,320,069, issued May 16, 1967, the disclosures of which are here incorporated by reference.

During silver halide grain precipitation or ripening small quantities of metal dopants in addition to those identified above as sensitivity increasing dopants can be added to modify other properties of high chloride emulsions being formed. Small quantities of iridium dopants decrease variations in sensitivity as a function of differing exposure times (i.e., improve reciprocity characteristics), as taught by Dostes et al U.S. Defensive Publication T962,004 and French Pat. No. 2,296,204. Iridium as a dopant also reduces temperature dependence, as specifically illustrated by Japanese Patent Publication 88340/1977. Iridium is preferably introduced in concentrations of from $10^{-8}$ to $10^{-5}$ mole per mole of silver. Rhodium as a dopant increases contrast, as taught by U.K. Pat. No. 775,197. Rhodium is preferably introduced in concentrations of from $4\times10^{-12}$ to $1\times10^{-7}$ mole per mole of silver. Mercury can be introduced as an antifoggant during precipitation or ripening (or after silver halide grain formation is complete, as discussed below), as illustrated by Allen et al U.S. Pat. No. 2,728,663. To avoid desensitization, mercury is introduced in concentrations of less than $10^{-6}$ mole per mole of silver. Each of the above metal dopants can be added in the form of metal salts according to conventional techniques. When a combination of metal dopants are employed, high chloride emulsions are obtained exhibiting high sensitivity in combination with other known dopant imparted advantages. The specific dopants and advantages discussed are, of course, only illustrative.

The emulsion containing high chloride silver halide grains is preferably washed or otherwise processed to remove soluble salts. The soluble salts can be removed by chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,555, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Sovient Chemical Industry*, Vol. 6, No. 3, 1974, pp. 181–185; by diafiltration with a semipermeable membrane, as illustrated by *Research Disclosure*, Vol. 102, October 1972, Item 10208, Hagemaier et al *Research Disclosure*, Vol. 131, March 1975, Item 13122, Bonnet *Research Disclosure*, Vol. 135, July 1975, Item 13577, Berg et al German OLS 2,436,461 and Bolton U.S. Pat. No. 2,495,918 or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure*, Vol. 101, September 1972, Item 10152.

In order to achieve the full improvement in sensitivity of this invention it is preferred that the internally doped high chloride silver halide grains be surface chemically sensitized. The high chloride silver halide grains can be surface chemically sensitized with active gelatin as illustrated by T. H. James, *The Theory of the Photographic Process*, 4th Ed., Macmillan, 1977, pp. 67–76, or with sulfur, selenium, tellurium, platinum, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by *Research Disclosure*, Vol. 120, April 1974, Item 12008, *Research Disclosure*, Vol. 134, June 1975, Item 13452, Sheppard et al U.S. Pat. No. 1,623,499, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Pat. No. 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633 and Oftedahl U.S. Pat. Nos. 3,901,714 and 3,904,415. The emulsions can also be reduction sensitized—e.g., with hydrogen, as illustrated by Janusonis U.S. Pat. No. 3,891,446 and Babcock et al U.S. Pat. No. 3,984,249, by low pAg (e.g., less than 5) high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al *Research Disclosure*, Vol. 136, August 1975, Item 13654, Lowe et al U.S. Pat. Nos. 2,518,698 and 2,743,182, Chambers et al U.S. Pat. No. 3,026,203 and Bigelow et al U.S. Pat. No. 3,361,564.

In a preferred form the internally doped high chloride silver halide grains are surface chemically sensitized with gold sensitizers employed alone or in combination with other conventional chemical sensitizers. The internally doped high chloride silver halide grains can be surface gold sensitized with one or a combination of conventional gold sensitizers. Illustrative gold sensitizers include gold hydroxide, gold chloride, potassium aurate, potassium auriaurite, potassium auricyanide, potassium aurithiocyanate, gold sulfide, gold selenide, gold silver sulfide, gold iodide, potassium chloroaurate, ethylenediamine-bis-gold chloride and various organic gold sensitizers, as more fully described by Damschroder et al U.S. Pat. No. 2,642,361 and McVeigh U.S. Pat. No. 3,297,447, the disclosures of which are here incorporated by reference.

Depending upon the photographic application, emulsions containing the high chloride silver halide grains can contain other components of a conventional nature. For example, it is specifically contemplated to blend the high chloride silver halide emulsions described above with other silver halide emulsions. Blending of silver halide emulsions is commonly undertaken to optimize characteristic curve shapes—e.g., adjust contrast, extend exposure latitude, increase maximum density and to achieve other, similar curve modifications. Blends of surface-sensitive emulsions and internally fogged, internal image-forming emulsions can be employed, as illustrated by Luckey et al U.S. Pat. Nos. 2,996,382, 3,397,987 and 3,705,858, Luckey U.S. Pat. No. 3,694,881, *Research Disclosure*, Vol. 134, June 1975, Item 13452, Millikan et al Defensive Publication T-904017, April 21, 1972 and Kurz *Research Disclosure*, Vol. 122, June 1974, Item 12233. In a specifically preferred form the major portion, preferably essentially all, of the silver halide grains present in a silver halide emulsion or silver halide emulsion layer are internally doped high chloride silver halide grains substantially as described above.

The silver halide emulsions can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium dihydronaphthothiazolium, pyrylium and imidazopyrazinium quaternary salts.

The mercoyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohyantoin, 2-pyrazolin-5-one, 2-isoxazolin-5-one, indan-1,3-dione, cyclohexan-1,3-dione, 1,3-dioxan-4,6-dione, pyrazolin-3,5-dione, pentan-2,4-dione, alkylsulfonyl acetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, *Photographic Science and Engineering,* Vol. 18, 1974, pp. 418–430.

Spectral sensitizing dyes also affect the emulsions in other ways. For example, many spectral sensitizing dyes either reduce (desensitize) or increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. 3,930,860.

Sensitizing action can be correlated to the position of molecular energy levels of a dye with respect to ground state and conduction band energy levels of the silver halide crystals. These energy levels can in turn be correlated to polyarographic oxidation and reduction potentials, as discussed in *Photographic Science and Engineering,* Vol. 18, 1974, pp. 49–53 (Sturmer et al), pp. 175–178 (Leubner) and pp. 475–485 (Gilman). Oxidation and reduction potentials can be measured as described by R. J. Cox, *Photographic Sensitivity,* Academic Press, 1973, Chapter 15.

The chemistry of cyanine and related dyes is illustrated by Weissberger and Taylor, *Special Topics of Heterocyclic Chemistry,* John Wiley and Sons, New York, 1977, Chapter VIII; Venkataraman, *The Chemistry of Synthetic Dyes,* Academic Press, New York, 1971, Chapter V; James, *The Theory of the Photographic Process,* 4th Ed., Macmillan, 1977, Chapter 8, and F. M. Hamer, *Cyanine Dyes and Related Compounds,* John Wiley and Sons, 1964.

Among useful spectral sensitizing dyes for sensitizing silver halide emulsions are those found in U.K. Pat. No. 742,112, Brooker U.S. Pat. Nos. 1,846,300, 1,846,301, 1,846,302, 1,846,303, 1,846,304, 2,078,233 and 2,089,729, Brooker et al U.S. Pat. Nos. 2,165,338, 2,213,238, 2,493,747, 2,493,748, 2,526,632, 2,739,964 (U.S. Pat. No. Re. 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Examples of useful supersensitizing dye combinations, of non-light absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898.

Instability which increases minimum density in negative type emulsion coatings (i.e., fog) can be protected against by incorporation of stabilizers, antifoggants, antikinking agents, latent image stabilizers and similar addenda in the emulsion and contiguous layers prior to coating. Most of the antifoggants which are effective in emulsions can also be used in developers and can be classified under a few general headings, as illustrated by C. E. K. Mees, *The Theory of the Photographic Process,* 2nd Ed., Macmillan, 1954, pp. 677–680.

To avoid such instability in emulsion coatings stabilizers and antifoggants can be employed, such as halide ions (e.g., bromide salts); chloropalladates and chloropalladites, as illustrated by Trivelli et al U.S. Pat. No. 2,829,405 and Sidebotham U.S. Pat. No. 3,488,709; mercury salts, as illustrated by Allen et al U.S. Pat. No. 2,728,663 (cited above); selenols and diselenides, as illustrated by Brown et al U.K. Pat. No. 1,336,570 and Pollet et al U.K. Pat. No. 1,282,303; quaternary ammonium salts of the type illustrated by Allen et al U.S. Pat. No. 2,694,716, Brooker Pat. No. 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes, as illustrated by Thiers et al U.S. Pat. No. 3,630,744; isothiourea derivatives, as illustrated by Herz et al U.S. Pat. No. 3,220,839 and Knott et al U.S. Pat. No. 2,514,650; thiazolidines, as illustrated by Scavron U.S. Pat. No. 3,565,625; peptide derivatives, as illustrated by Maffet U.S. Pat. No. 3,274,002; pyrimidines and 3-pyrazolidones, as illustrated by Welsh U.S. Pat. No. 3,161,515 and Hood et al U.S. Pat. No. 2,751,297; azotriazoles and azotetrazoles, as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure,* Vol. 134, June 1975, Item 13452, and Vol. 148, August 1976, Item 14851, and Nepker et al U.K. Pat. No. 1,338,567; mercaptotetrazoles, -triazoles and -diazoles, as illustrated by Kendall et al U.S. Pat. No. 2,403,927, Kennard et al U.S. Pat. No. 3,266,897, *Research Disclosure,* Vol. 116, December 1973, Item 11684, Luckey et al U.S. Pat. No. 3,397,987 and Salesin U.S. Pat. No. 3,708,303; azoles, as illustrated by Peterson et al U.S. Pat. No. 2,271,229 and *Research Disclosure,* Item 11684, cited above; purines, as illustrated by Sheppard et al U.S. Pat. No. 2,319,090, Birr et al U.S. Pat. No. 2,152,460, *Research Disclosure,* Item 13452, cited above, and Dostes et al French Patent 2,296,204 and polymers of 1,3-dihydroxy (and/or 1,3-carbamoxy)-2-methylenepropane, as illustrated by Saleck et al U.S. Pat. No. 3,926,635.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Pat. No. 1,466,024 and Habu et al U.S. Pat. No. 3,929,486; quaternary ammonium salts of the type illustrated by Piper U.S. Pat. No. 2,886,437; water-insoluble hydroxides, as illustrated by Maffet U.S. Pat. No. 2,953,455; phenols, as illustrated by Smith U.S. Pat. No. 2,955,037 and '038; ethylene diurea, as illustrated by Dersch U.S. Pat. No. 3,582,346; barbituric acid derivatives, as illustrated by Wood U.S. Pat. No. 3,617,290; boranes, as illustrated by Bigelow U.S. Pat. No. 3,725,078; 3-pyrazolidinones, as illustrated by Wood U.K. Pat. No. 1,158,059 and aldoximines, amides, anilides and esters, as illustrated by Butler et al U.K. Pat. No. 988,052.

The emulsion layers can be protected from fog and desensitization caused by contamination by metals such as copper, lead, tin, iron and the like, by incorporating addenda, such as sulfocatechol-type compounds, as illustrated by Kennard et al U.S. Pat. No. 3,236,652; aldoximines, as illustrated by Carroll et al U.K. Pat. No. 623,448 and meta- and poly-phosphates, as illustrated by Draisbach U.S. Pat. No. 2,239,284, and carboxylic acids such as ethylenediamine tetraacetic acid, as illustrated by U.K. Pat. No. 691,715.

Among stabilizers useful in layers containing synthetic polymers of the type employed as vehicles and to improve covering power are monohydric and polyhydric phenols, as illustrated by Forsgard U.S. Pat. No. 3,403,697; saccharides, as illustrated by U.K. Pat. No. 897,497 and Stevens et al U.K. Pat. No. 1,039,471 and quinoline derivatives, as illustrated by Dersch et al U.S. Pat. No. 3,446,618.

Among stabilizers useful in protecting the emulsion layers against dichroic fog are addenda, such as salts of nitron, as illustrated by Barbier et al U.S. Pat. Nos. 3,679,424 and 3,820,998; mercaptocarboxylic acids, as illustrated by Willems et al U.S. Pat. No. 3,600,178, and addenda listed by E. J. Birr, *Stabilization of Photographic Silver Halide Emulsions,* Focal Press, London, 1974, pp. 126–218.

Among stabilizers useful in protecting emulsion layers against development fog are addenda such as azabenzimidazoles, as illustrated by Bloom et al U.K. Pat. No. 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like, as illustrated by Brooker et al U.S. Pat. No. 2,131,038, Land U.S. Pat. No. 2,704,721, Rogers et al U.S. Pat. No. 3,265,498; mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives, as illustrated by Herz et al U.S. Pat. No. 3,220,839, and thiodiazole derivatives, as illustrated by von Konig U.S. Pat. No. 3,364,028 and von Konig et al U.K. Pat. No. 1,186,441.

Where hardeners of the aldehyde type are employed, the emulsion layers can be protected with antifoggants, such as monohydric and polyhydric phenols of the type illustrated by Sheppard et al U.S. Pat. No. 2,165,421; nitro-substituted compounds of the type disclosed by Rees et al U.K. Pat. No. 1,269,268; poly(alkylene oxides), as illustrated by Valbusa U.K. Pat. No. 1,151,914, and mucohalogenic acids in combination with urazoles, as illustrated by Allen et al U.S. Pat. Nos. 3,232,761 and 3,232,764, or further in combination with maleic acid hydrazide, as illustrated by Rees et al U.S. Pat. No. 3,295,980.

To protect emulsion layers coated on linear polyester supports addenda can be employed such as parabanic acid, hydantoin acid hydrazides and urazoles, as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of compounds, polymeric latices and dispersions of the type disclosed by Jones et al U.S. Pat. Nos. 2,759,821 and '822; azole and mercaptotetrazole hydrophilic colloid dispersions of the type disclosed by *Research Disclosure,* Vol. 116, December 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric latices prepared by emulsion polymerization in the presence of poly(alkylene oxide), as disclosed by Pearson et al U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased fog can be controlled by selected combinations of addenda, vehicles, hardeners and/or processing conditions, as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure,* Vol. 99, July 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing the pAg of an emulsion and adding gelatin, which are known to retard latent image fading, latent image stabilizers can be incorporated, such as amino acids, as illustrated by Ezekiel U.K. Pat. Nos. 1,335,923, 1,378,354, 1,387,654 and 1,391,672, Ezekiel et al U.K. Pat. No. 1,394,371, Jefferson U.S. Pat. No. 3,843,372, Jefferson et al U.K. Pat. No. 1,412,294 and Thurston U.K. Pat. No. 1,343,904; carbonyl-bisulfite addition products in combination with hydroxybenzene or aromatic amine developing agents, as illustrated by Seiter et al U.S. Pat. No. 3,424,583; cycloalkyl-1,3-diones, as illustrated by Beckett et al U.S. Pat. No. 3,447,926; enzymes of the catalase type, as illustrated by Matejec et al U.S. Pat. No. 3,600,182; halogen-substituted hardeners in combination with certain cyanine dyes, as illustrated by Kumai et al U.S. Pat. No. 3,881,933; hydrazides, as illustrated by Honig et al U.S. Pat. No. 3,386,831; alkenylbenzothiazolium salts, as illustrated by Arai et at U.S. Pat. No. 3,954,478; hydroxy-substituted benzylidene derivatives, as illustrated by Thurston U.K. Pat. No. 1,308,777 and Ezekiel et al U.K. Pat. Nos. 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives, as illustrated by Ezekiel U.K. Pat. No. 1,389,089; propynylthio derivatives of benzimidazoles, pyrimidines, etc., as illustrated by von Konig et al U.S. Pat. No. 3,910,791; combinations of iridium and rhodium compounds, as disclosed by Yamasue et al U.S. Pat. No. 3,901,713; sydnones or sydnone imines, as illustrated by Noda et al U.S. Pat. No. 3,881,939; thiazolidine derivatives, as illustrated by Ezekiel U.K. Pat. No. 1,458,197 and thioether-substituted imidazoles, as illustrated by *Research Disclosure,* Vol. 136, August 1975, Item 13651.

The photographic elements can be color photographic elements which form dye images through the selective destruction, formation or physical removal of dyes.

The photographic elements can produce dye images through the selective destruction of dyes or dye precursors, such as silver-dye-bleach processes, as illustrated by A. Meyer, *The Journal of Photographic Science,* Vol. 13, 1965, pp. 90–97. Bleachable azo, azoxy, xanthene, azine, phenylmethane, nitroso complex, indigo, quinone, nitro-substituted, phthalocyanine and formazan dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291 and Anderau et al U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al U.S. Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372 and Puschel et al U.S. Pat. No. 3,561,970, can be employed.

The photographic elements can produce dye images through the selective formation of dyes, such as by reacting (coupling) a color-developing agent (e.g., a primary aromatic amine) in its oxidized form with a dye-forming coupler. The dye-forming couplers can be incorporated in the photographic elements, as illustrated by Schnelder et al, Die Chemie, Vol. 57, 1944, p. 113, Mannes et al U.S. Pat. No. 2,304,940, Martinez U.S. Pat. No. 2,269,158, Jelly et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435 and Chen *Research Disclosure,* Vol. 159, July 1977, Item 15930.

In one form the dye-forming couplers are chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. 3,222,176 and Canadian Pat. No. 726,651, Schulte et al U.K. Pat. No. 1,248,924 and Whitmore et al U.S. Pat. No. 3,227,550.

The photographic elements can incorporate alkali-soluble ballasted couplers, as illustrated by Froelich et al and Tong, cited above. The photographic elements can be adapted to form non-diffusible image dyes using dye-forming couplers in developers, as illustrated by U.K. Pat. No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343, 703, 2,376,380 and 2,369,489, Spath U.K. Pat. No. 886,723 and U.S. Pat. No. 2,899,306, Tuite U.S. Pat. No. 3,152,896 and Mannes et al U.S. Pat. Nos. 2,115,394, 2,252,718 and 2,108,602.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Patent 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,642,485, Verbrugghe U.K. Patent 1,236,767, Fujiwhara et al U.S. Pat. No. 3,770,436 and Matsuo et al U.S. Pat. No. 3,808,945. DIR compounds which do not form dye upon reaction with oxidized color-developing agents can be employed, as illustrated by Fujiwhara et al German OLS No. 2,529,350 and U.S. Pat. Nos. 3,928,041, 3,958,993 and 3,961,959, Odenwalder et al German OLS No. 2,448,063, Tanaka et al German OLS No. 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129.

The photographic elements can incorporate colored dye-forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432 and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832 and Weller et al U.S. Pat. No. 2,689,793.

The photographic elements can produce dye images through the selective removal of dyes. Negative or positive dye images can be produced by the immobilization or mobilization of incorporated color-providing substances (e.g., redox dye-releasers) as a function of exposure and development, as illustrated by U.K. Pat. Nos. 1,456,413, 1,479,739, 1,475,265 and 1,471,752, Friedman U.S. Pat. No. 2,543,691, Whitmore U.S. Pat. No. 3,227,552, Bloom et al U.S. Pat. No. 3,443,940, Morse U.S. Pat. No. 3,549,364, Cook U.S. Pat. No. 3,620,730, Danhauser U.S. Pat. No. 3,730,718, Staples U.S. Pat. No. 3,923,510, Oishi et al U.S. Pat. No. 4,052,214 and Fleckenstein et al U.S. Pat. No. 4,076,529.

The photographic elements can contain antistain agents (i.e., oxidized developing agent scavengers) to prevent developing agents oxidized in one dye image layer unit from migrating to an adjacent dye image layer unit. Such antistain agents include ballasted or otherwise nondiffusing antioxidants, as illustrated by Weissberger et al U.S. Pat. No. 2,336,327, Loria et al U.S. Pat. No. 2,728,659, Vittum et al U.S. Pat. No. 2,360,290, Jelley et al U.S. Pat. No. 2,403,721 and Thirtle et al U.S. Pat. No. 2,701,197. To avoid autooxidation the antistain agents can be employed in combination with other antioxidants, as illustrated by Knechel et al U.S. Pat. No. 3,700,453.

The photographic elements can include image dye stabilizers. Such image dye stabilizers are illustrated by U.K. Pat. No. 1,326,889,. Lestina et al U.S. Pat. Nos. 3,432,300 and 3,698,909, Stern et al U.S. Pat. No. 3,574,627, Brannock et al U.S. Pat. No. 3,573,050, Arai et al U.S. Pat. No. 3,764,337 and Smith et al U.S. Pat. No. 4,042,394.

The sensitizing dyes and other addenda incorporated into the layers of the photographic elements can be dissolved and added prior to coating either from water or organic solvent solutions, depending upon the solubility of the addenda. Ultrasound can be employed to dissolve addenda, as illustrated by Owen et al U.S. Pat. No. 3,485,634 and Salminen U.S. Pat. No. 3,551,157. Semipermeable and ion exchange membranes can be used to introduce addenda, such as water soluble ions (e.g., chemical sensitizers). Hydrophobic addenda, particularly those which need not be adsorbed to the silver halide grain surfaces to be effective, such as couplers, redox dye-releasers and the like, can be mechanically dispersed directly, as illustrated by Belgian Pat. No. 852,138, or in high boiling (coupler) solvents, as illustrated by Jelley et al U.S. Pat. No. 2,322,027 and Fierke et al U.S. Pat. No. 2,801,171, or the hydrophobic addenda can be loaded into latices and dispersed, as illustrated by Chen *Research Disclosure*, Vol. 159, July 1977, Item 15930.

Exemplary apparatus and procedures for introducing and blending addenda are illustrated by Johnson et al U.S. Pat. Nos. 3,425,835, 3,570,818, 3,773,302 and 3,850,643, McCrossen et al U.S. Pat. No. 3,342,605, Collins et al U.S. Pat. No. 2,912,343 and Terwilliger et al U.S. Pat. Nos. 3,827,888 and 3,888,465.

In forming photographic elements the layers can be applied to photographic supports by various procedures, including immersion or dip coating, roller coating, reverse roll coating, air knife coating, doctor blade coating, gravure coating, spray coating, extrusion coating, bead coating, stretch-flow coating and curtain coating. High speed coating using a pressure differential is illustrated by Beguin U.S. Pat. No. 2,681,294. Controlled variation in the pressure differential to facilitate coating starts is illustrated by Johnson U.S. Pat. No. 3,220,877 and to minimize splicing disruptions is illustrated by Fowble U.S. Pat. No. 3,916,043. Coating at reduced pressures to accelerate drying is illustrated by Beck U.S. Pat. No. 2,815,307. Very high speed curtain coating is illustrated by Greiller U.S. Pat. No. 3,632,374. Two or more layers can be coated simultaneously, as illustrated by Russell U.S. Pat. No. 2,761,791, Wynn U.S. Pat. No. 2,941,898, Miller et al U.S. Pat. No. 3,206,323, Bacon et al U.S. Pat. No. 3,425,857, Hughes U.S. Pat. No. 3,508,947, Herzhoff et al U.K. Pat. No. 1,208,809, Herzhoff et al U.S. Pat. No. 3,645,773 and Dittman et al U.S. Pat. No. 4,001,024. In simultaneous multilayer coating varied coating hoppers can be used, as illustrated by Russell et al U.S. Pat. No. 2,761,417, Russell U.S. Pat. Nos. 2,761,418 and 3,474,758, Mercier et al U.S. Pat. No. 2,761,419, Wright U.S. Pat. No. 2,975,754, Padday U.S. Pat. No. 3,005,440, Mercier U.S. Pat. No. 3,627,564, Timson U.S. Pat. Nos. 3,749,053 and 3,958,532, Jackson U.S. Pat. No. 3,993,019 and Jackson et al U.S. Pat. No. 3,996,885. Silver halide layers can also be coated by vacuum evaporation, as illustrated by Lu Valle et al U.S. Pat. Nos. 3,219,444 and 3,219,451.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamides, homo- and co-polymers of vinyl chloride, poly(vinyl acetal), polycarbonate, homo- and co-polymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an $\alpha$-olefin containing 2 to 10 carbon atoms, such as polyethylene, polypropylene, copolymers of ethylene and propylene and the like.

Polyolefins, such as polyethylene, polypropylene and polyallomers—e.g., copolymers of ethylene with propylene, as illustrated by Hagemeyer et al U.S. Pat. No. 3,478,128, are preferably employed as resin coatings over paper, as illustrated by Crawford et al U.S. pat. No. 3,411,908 and Joseph et al U.S. Pat. No. 3,630,740, over polystyrene and polyester film supports, as illustrated by Crawford et al U.S. Pat. No. 3,630,742, or can be employed as unitary flexible reflection supports, as illustrated by Venor et al U.S. Pat. No. 3,973,963.

Preferred cellulose ester supports are cellulose triacetate supports, as illustrated by Fordyce et al U.S. Pat. Nos. 2,492,977, '978 and 2,739,069, as well as mixed cellulose ester supports, such as cellulose acetate propionate and cellulose acetate butyrate, as illustrated by Fordyce et al U.S. Pat. No. 2,739,070.

Preferred polyester film supports are comprised of linear polyester, such as illustrated by Alles et al U.S. Pat. No. 2,627,088, Wellman U.S. Pat. No. 2,720,503, Alles U.S. Pat. No. 2,779,684 and Kibler et al U.S. Pat. No. 2,901,466. Polyester films can be formed by varied techniques, as illustrated by Alles, cited above, Czerkas et al U.S. Pat. No. 3,663,683 and Williams et al U.S. Pat.

No. 3,504,075, and modified for use as photographic film supports, as illustrated by Van Stappen U.S. Pat. No. 3,227,576, Nadeau et al U.S. Pat. No. 3,501,301, Reedy et al U.S. Pat. No. 3,589,905, Babbitt et al U.S. Pat. No. 3,850,640, Bailey et al U.S. Pat. No. 3,888,678, Hunter U.S. Pat. No. 3,904,420 and Mallinson et al U.S. Pat. No. 3,928,697.

The photographic elements can employ supports which are resistant to dimensional change at elevated temperatures. Such supports can be comprised of linear condensation polymers which have glass transition temperatures above about 190° C., preferably 220° C., such as polycarbonates, polycarboxylic esters, polyamides, polysulfonamides, polyethers, polyimides, polysulfonates and copolymer variants, as illustrated by Hamb U.S. Pat. Nos. 3,634,089 and 3,772,405; Hamb et al U.S. Pat. Nos. 3,725,070 and 3,793,249; Wilson *Research Disclosure,* Vol. 118, February 1974, Item 11833, and Vol. 120, April 1974, Item 12046; Conklin et al *Research Disclosure,* Vol. 120, April 1974, Item 12012; *Product Licensing Index,* Vol. 92, December 1971, Items 9205 and 9207; *Research Disclosure,* Vol. 101, September 1972, Items 10119 and 10148; *Research Disclosure,* Vol. 106, February 1973, Item 10613; *Research Disclosure,* Vol. 117, January 1974, Item 11709, and *Research Disclosure,* Vol. 134, June 1975, Item 13455.

The photographic elements of this invention show particularly advantageous sensitivities when exposed to light. The photographic elements are specifically contemplated for imagewise exposure under ordinary lighting conditions—that is, less than high intensity lighting conditions. Exposures can be monochromatic, orthochromatic or panchromatic. Imagewise exposures at ambient, elevated or reduced temperatures and/or pressures, continuous or intermettent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18 and 23.

Upon imagewise exposure the high chloride silver halide grains form latent image sites at or near their surface, both in their primitive state and after surface chemical sensitization, unless the emulsions as described above are otherwise modified. Accordingly the emulsions can be processed in all conventional silver halide developers—including those containing sufficient silver halide solvent to reveal internal latent image sites, referred to in the art as surface and sub-surface developers, and those containing higher levels of silver halide solvents, referred to in the art as internal developers. It is accordingly apparent that the emulsions as described above are useful for photographic applications requiring negative-working silver halide emulsions and photographic elements.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973; *Photo-Lab Index,* Morgan and Morgan, Inc., Dobbs Ferry, New York, 1977, and *Neblette's Handbook of Photography and Reprography—Materials, Processes and Systems,* VanNostrand Reinhold Company, 7th Ed., 1977.

Included among the processing methods are web processing, as illustrated by Tregillus et al U.S. Pat. No. 3,179,517; stabilization processing, as illustrated by Herz et al U.S. Pat. No. 3,220,839, Cole U.S. Pat. No. 3,615,511, Shipton et al U.K. Pat. No. 1,258,906 and Haist et al U.S. Pat. No. 3,647,453; monobath processing as described in Haist, *Monobath Manual,* Morgan and Morgan, Inc., 1966, Schuler U.S. Pat. No. 3,240,603, Haist et al U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al U.S. Pat. No. 3,625,689, Illingsworth U.S. Pat. No. 3,632,340, Salesin U.K. Pat. No. 1,273,030 and U.S. Pat. No. 3,708,303; hardening development, as illustrated by Allen et al U.S. Pat. No. 3,232,761; roller transport processing, as illustrated by Russell et al U.S. Pat. Nos. 3,025,779 and 3,515,556, Masseth U.S. Pat. No. 3,573,914, Taber et al U.S. Pat. No. 3,647,459 and Rees et al U.K. Pat. No. 1,269,268; alkaline vapor processing, as illustrated by *Product Licensing Index,* Vol. 97, May 1972, Item 9711, Goffe et al U.S. Pat. No. 3,816,136 and King U.S. Pat. No. 3,985,564; metal ion development as illustrated by Price, *Photographic Science and Engineering,* Vol. 19, Number 5, 1975, pp. 283–287 and Vought *Research Disclosure,* Vol. 150, October 1976, Item 15034; reversal processing, as illustrated by Henn et al U.S. Pat. No. 3,576,633; and surface application processing, as illustrated by Kitze U.S. Pat. No. 3,418,132.

The photographic elements can be processed to form dye images which correspond to or are reversals of the silver halide rendered selectively developable by imagewise exposure.

Multicolor reversal dye images can be formed in photographic elements having differentially spectrally sensitized silver halide layers by black-and-white development followed by (i) where the elements lack incorporated dye image formers, sequential reversal color development with developers containing dye image formers, such as color couplers, as illustrated by Mannes et al U.S. Pat. No. 2,252,718, Schwan et al U.S. Pat. No. 2,950,970 and Pilato U.S. Pat. No. 3,547,650; (ii) where the elements contain incorporated dye image formers, such as color couplers, a single color development step, as illustrated by the Kodak Ektachrome E4 and E6 and Agfa processes described in *British Journal of Photography Annual,* 1977, pp. 194–197, and *British Journal of Photography,* August 2, 1974, pp. 668–669; and (iii) where the photographic elements contain bleachable dyes, silver-dye-bleach processing, as illustrated by the Cibachrome P-10 and P-18 processes described in the *British Journal of Photography Annual,* 1977, pp. 209–212.

The photographic elements can be adapted for direct color reversal processing (i.e., production of reversal color images without prior black-and-white development), as illustrated by U.K. Pat. No. 1,075,385, Barr U.S. Pat. No. 3,243,294, Hendess et al U.S. Pat. No. 3,647,452, Puschel et al German Pat. No. 1,257,570 and U.S. Pat. Nos. 3,457,077 and 3,467,520, Accary-Venet et al U.K. Pat. No. 1,132,736, Schranz et al German Pat. No. 1,259,700, Marx et al German Pat. No. 1,259,701 and Muller-Bore German OLS 2,005,091.

Multicolor dye images which correspond to the silver halide rendered selectively developable by imagewise exposure, typically negative dye images, can be produced by processing, as illustrated by the Kodacolor C-22, the Kodak Flexicolor C-41 and the Agfacolor processes described in *British Journal of Photography Annual,* 1977, pp. 201-205. The photographic elements can also be processed by the Kodak Ektaprint-3 and -300 processes as described in Kodak Color Dataguide, 5th Ed., 1975, pp. 18-19, and the Agfa color process as described in *British Journal of Photography Annual,* 1977, pp. 205-206, such processes being particularly suited to processing color print materials, such as resin-coated photographic papers, to form positive dye images.

The photographic elements can be processed in the presence of reducible species, such as transition metal ion complexes (e.g. cobalt(III) and ruthenium(III) complexes containing amine and/or ammine ligands) and peroxy compounds (e.g. hydrogen peroxide and alkali metal perborates and percarbonates).

Dye images can be formed or amplified by processes which employ in combination with a dye-image-generating reducing agent an inert transition metal ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent, as illustrated by Matejec U.S. Pat. No. 3,674,490, *Research Disclosure,* Vol. 116, December 1973, Item 11660, and Bissonette *Research Disclosure,* Vol. 148, August 1976, Items 14836, 14846 and 14847. The photographic elements can be particularly adapted to form dye images by such processes, as illustrated by Dunn et al U.S. Pat. No. 3,822,129, Bissonette U.S. Pat. Nos. 3,834,907 and 3,902,905, Bissonette et al U.S. Pat. No. 3,847,619 and Mowrey U.S. Pat. No. 3,904,413.

The presence of transition metal ion complexes can accelerate silver halide development, as illustrated by Bissonette U.S. Pat. No. 3,748,138, Beavers U.S. Pat. No. 3,901,712 and Price U.S. Pat. No. 3,964,912; can bleach silver images, as illustrated by Bissonette U.S. Pat. No. 3,923,511 and *Research Disclosure,* Item 14846, and can be employed to form tanned colloid images, as illustrated by Bissonette U.S. Pat. No. 3,856,524 and McGuckin U.S. Pat. No. 3,862,855.

The peroxide oxidizing agents can be employed to form vesicular images, as illustrated by Weyde U.S. Pat. No. 3,615,491, Weyde et al U.K. Pat. No. 1,329,444 and U.S. Pat. No. 3,765,890, Meyer et al U.K. Pat. No. 1,332,693, Liebe et al German OLS No. 2,420,521 and Matejec et al U.S. Pat. No. 3,776,730.

The emulsions and photographic elements of this invention can form a part of an otherwise conventional image transfer system. Image transfer systems include colloid transfer systems, as illustrated by Yutzy et al U.S. Pat. Nos. 2,596,756 and2,716,059; silver salt diffusion transfer systems, as illustrated by Rott U.S. Pat. No. 2,352,014, Land U.S. Pat. No. 2,543,181, Yackel et al U.S. Pat. No. 3,020,155 and Land U.S. Pat. No. 2,861,885; imbibition transfer systems, as illustrated by Minsk U.S. Pat. No. 2,882,156, and color image transfer systems, as illustrated by *Research Disclosure,* Vol. 151, November 1976, Item 15162, and Vol. 123, July 1974, Item 12331.

Color image transfer systems (including emulsion layers, receiving layers, timing layers, acid layers, processing compositions, supports and cover sheets) and the images they produce can be varied by choosing among a variety of features, combinations of which can be used together as desired.

Film units can be chosen which are either integrally laminated or separated during exposure, processing and/or viewing, as illustrated by Rogers U.S. Pat. No. 2,983,606, Beavers et al U.S. Pat. No. 3,445,228, Whitmore Canadian Pat. No. 674,082, Friedman et al U.S. Pat. No. 3,309,201, Land U.S. Pat. Nos. 2,543,181, 3,053,659, 3,415,644, 3,415,645 and 3,415,646 and Barr et al U.K. Pat. No. 1,330,524.

Positive-working chemistry can be chosen utilizing initially mobile dyes which are immobilized by development, as illustrated by Rogers U.S. Pat. No. 2,983,606, Yutzy U.S. Pat. No. 2,756,142, Lestina et al U.S. Pat. No. 3,880,658, Bush et al U.S. Pat. No. 3,854,945 and Janssens et al U.S. Pat. No. 3,839,035, or initially immobile dyes which are rendered mobile by development, as illustrated by Hinshaw et al U.K. Pat. No. 1,464,104 and Fields U.S. Pat. No. 3,980,479; or negative-working imaging chemistry can be chosen utilizing the release of diffusible dyes from an immobile image dye-forming compound (e.g., a redox dye-releaser) as a function of development, as illustrated by Belgian Pat. No. 838,062, Whitmore et al Canadian Pat. No. 602,607 and U.S. Pat. No. 3,227,550, Bloom et al U.S. Pat. No. 3,443,940, Puschel et al U.S. Pat. Nos. 3,628,952 and 3,844,785, Gompf et al U.S. Pat. No. 3,698,897, Anderson et al U.S. Pat. No. 3,725,062, Becker et al U.S. Pat. No. 3,728,113, Fleckenstein U.S. Pat. No. 4,053,312, Fleckenstein et al U.S. Pat. No. 4,076,529, Melzer et al U.K. Pat. No. 1,489,695, Degauchi German OLS No. 2,729,820 and Kestner et al *Research Disclosure,* Vol. 151, November 1976, Item 15157.

An image to be viewed can be transferred from the image-forming layers. A retained image can be formed for viewing as a concurrently formed complement of the transferred image. Positive transferred images and useful negative retained images can be formed when one of the imaging chemistry and the emulsion is negative-working and the other positive-working; and negative transferred images and positive retained images can be formed when both the imaging chemistry and the emulsion(s) are negative-working or positive-working. Images retained in and transferred from the image-forming layers are illustrated by U.K. Pat. No. 1,456,413, Friedman U.S. Pat. No. 2,543,691, Bloom et al U.S. Pat. No. 3,443,940, Staples U.S. Pat. No. 3,923,510 and Fleckenstein et al U.S. Pat. No. 4,076,529.

One-step processing can be employed, as illustrated by U.K. Pat. No. 1,471,752, Land U.S. Pat. No. 2,543,181, Rogers U.S. Pat. No. 2,983,606 (pod processing), Land U.S. Pat. No. 3,485,628 (soak image-former and laminate to receiver) and Land U.S. Pat. No. 3,907,563 (soak receiver and laminate to image-forming element); or multi-step processing can be employed, as illustrated by Yutzy U.S. Pat. No. 2,756,142, Whitmore et al U.S. Pat. No. 3,227,550 and Faul et al U.S. Pat. No. 3,998,637.

Preformed reflective layers can be employed as illustrated by Whitmore Canadian Pat. No. 674,082, Beavers U.S. Pat. No. 3,445,228, Land U.S. Pat. Nos. 2,543,181, 3,415,644, 3,415,645 and 3,415,646, and Barr et al U.K. Pat. No. 1,330,524; or processing-formed reflective layers can be employed, as illustrated by Land U.S. Pat. Nos. 2,607,685 and 3,647,437, Rogers U.S. Pat. No. 2,983,606 and Buckler U.S. Pat. No. 3,661,585.

In addition to the silver halide emulsion and photographic element features specifically indicated above, it is appreciated that other conventional features requiring no detailed description can also be present. For example, the photographic elements can contain brighteners, absorbing and scattering materials, hardeners, coating aids, plasticizers and lubricants, antistatic layers, matting agents, developing agents and development modifiers as described in Paragraphs V, VIII, X, XI, XII, XIII, XVI, XX and XXI, of *Research Disclosure,* Vol. 1976, December 1978, Item 17643. Still other conventional photographic features and applications not inconsistent with this invention will be readily apparent to those skilled in the art.

*Product Licensing Index* and *Research Disclosure* are published by Industrial Opportunities Ltd., Homewell, Havant, Hampshire, PO9 1EF, United Kingdom.

In a specific preferred form the photographic elements of this invention are intended to produce multicolor images which can be viewed in the elements or in a receiver when the elements form a part of a multicolor image transfer system. For multicolor imaging at least three superimposed color-forming layer units are coated on a support. Each of the layer units is comprised of at least one silver halide emulsion layer. At least one of the silver halide emulsion layers, preferably at least one of the silver halide emulsion layers in each color forming layer unit and most preferably each of the silver halide emulsion layers, contain an emulsion according to this invention substantially as described above. The emulsion layers of one of the layer units are primarily responsive to the blue region of the spectrum, the emulsion layers of a second of the layer units are primarily responsive to the green region of the spectrum, and the emulsion layers of a third of the layer units are primarily responsive to the red region of the spectrum. Since the high chloride silver halide emulsions exhibit only limited native sensitivity to the visible portion of the spectrum, the use of yellow filter dyes between adjacent layer units can be omitted in many instances and the layer units can be coated in any desired order. The layer units each contain in the emulsion layers or in adjacent hydrophilic colloid layers at least one image dye providing compound. Such compounds can be selected from among those described above. Incorporated dye-forming couplers and redox dye-releasers constitute exemplary preferred image dye providing means. The blue, green and red responsive layer units preferably contain yellow, magenta and red image dye providing means, respectively.

The invention is further illustrated by the following examples.

EXAMPLE 1

1A. A polydisperse silver chloride emulsion, mean grain size about 0.45 μm, was prepared in the following manner:

Two solutions were prepared as follows:

| Solution 1 (Placed in the Reaction Vessel) | |
|---|---|
| Gelatin | 100 g |
| Distilled Water | 7000 ml |
| Sodium Chloride | 425 g |
| Dissolve at 40° C. | |
| Adjust pH to 3.0 with $HNO_3$ | |
| **Solution 2** | |
| Silver Nitrate | 850 g |
| Distilled Water to total volume | 2900 ml |
| Dissolve at 40° C. | |
| Adjust pH to 3.0 with $HNO_3$ | |

To solution 1 were added 1.7 mg of a fog inhibiting agent of the type described in Allen et al U.S. Pat. No. 2,728,663. Solution 2 was then added to the reaction vessel, at a constant flow rate, over a 40 minute period, with continuous agitation. Following precipitation the pH was adjusted to 4.5, a pH coaguable gelatin derivative was added to the emulsion, and the emulsion was washed using the procedure described in Example 3 of Yutzy et al U.S. Pat. No. 2,614,929.

1B. A cadmium doped polydisperse silver chloride emulsion, mean grain size about 0.45 μm, was prepared as described above, except that 10 mg of cadmium chloride ($1.1\times10^{-5}$ mole/Ag mole) were added to the reaction vessel 5 minutes after the start of the precipitation.

The polydisperse silver chloride emulsions prepared as described above were coated, unsensitized and optimally gold sensitized, on a cellulose acetate film support at coverages of 6.90 g gelatin and 4.65 g Ag/m$^2$. The coated elements were then exposed through a graduated density step wedge, developed for 5′ in Kodak Developer DK-50, fixed, washed and dried. The sensitometric results are set forth below in Table II.

TABLE II

| Cadmium Internal Dopant | Gold Sensitized | Relative Speed |
|---|---|---|
| No | No | 100 |
| Yes | No | 132 |
| No | Yes | 355 |
| Yes | Yes | 501 |

From Table II it can be seen that the inclusion of cadmium as a dopant in a polydisperse silver chloride emulsion unexpectedly results in an increase in speed of the emulsion compared to an emulsion similarly prepared but lacking a cadmium dopant.

EXAMPLE 2

2A. A monodisperse silver chloride emulsion (1.5 μm) was prepared in the following manner:

Three solutions were prepared as follows:

| Solution 1 (Placed in the Reaction Vessel) | |
|---|---|
| Gelatin | 100 g |
| Distilled Water | 7000 ml |
| Dissolve at 40° C. | |
| Adjust pH to 2.0 | |
| **Solution 2** | |
| Sodium Chloride | 425 g |
| Distilled Water to total volume | 2900 ml |
| Dissolve at 40° C. | |
| **Solution 3** | |
| Silver Nitrate | 850 g |
| Distilled Water to total volume | 2900 ml |
| Dissolve at 40° C. | |

To solution 1 were added 2.5 g of a silver halide ripening agent of the type described in McBride U.S. Pat. No. 3,271,157. The pAg of solution 1 was then adjusted to 8.0 using solution 2. Solutions 2 and 3 were then simultaneously run into solution 1 over a 40 minute period using an accelerated flow technique, maintaining the pAg at 8.0. Following precipitation the pH was raised to 5.5, a pH coaguable gelatin derivative was added to the emulsion, and the emulsion was washed using the procedure described in Example 3 of Yutzy et al U.S. Pat. No. 2,614,929.

2B. A cadmium doped monodisperse silver chloride emulsion (1.5 μm) was prepared as described above (A), except that 2 mg of cadmium chloride ($1.1\times10^{-5}$ mole-/Ag mole) were added to the reaction vessel prior to the start of the precipitation.

The monodisperse silver chloride emulsions prepared as described above (A and B) were optimally gold sensitized and coated and tested as described in Example 1. The sensitometric results are set forth below in Table III.

TABLE III

| Cadmium Internal Dopant | Relative Speed |
|---|---|
| No | 100 |
| Yes | 162 |

From Table III it can be seen that the inclusion of cadmium as a dopant in a monodisperse silver chloride emulsion unexpectedly results in an increase in speed of the emulsion compared to an emulsion similarly prepared but lacking a cadmium dopant.

EXAMPLE 3

A series of monodisperse silver chloride emulsions of approximately equal grain size (1.4–1.5 μm) were prepared by a method similar to that utilized in Example 2, except that varying amounts of cadmium chloride were added to the reaction vessel 5 minutes after the start of precipitation. The resulting emulsions were then optimally gold sensitized, coated and processed as described in Example1. Table Iv shows the concentrations of cadmium chloride utilized in the various emulsions. Relative speeds for these emulsions are shown in Curve A in FIG. 1.

TABLE IV

| Cadmium Chloride | | Emulsion |
|---|---|---|
| mg/Ag mole | Mole/Ag mole | Grain Size (μm) |
| No cadmium chloride added | | 1.5 |
| 0.5 | $2.75\times10^{-6}$ | 1.4 |
| 1.0 | $5.5\times10^{-6}$ | 1.5 |
| 2.0 | $1.1\times10^{-5}$ | 1.5 |
| 4.0 | $2.2\times10^{-5}$ | 1.5 |
| 8.0 | $4.4\times10^{-5}$ | 1.5 |
| 12.0 | $6.6\times10^{-5}$ | 1.5 |

EXAMPLE 4

A series of monodisperse silver chloride emulsions were prepared by a method similar to that described in Example 2, except that varying amounts of lead chloride were added 5 minutes after the start of the precipitation. The resulting emulsions were then optimally gold chemically sensitized and processed as described in Example 1. Table V shows the concentrations of lead chloride utilized. Relative speeds are shown in Curve B in FIG. 1.

TABLE V

| Lead Chloride | | Emulsion |
|---|---|---|
| mg/Ag mole | Mole/Ag mole | Grain Size (μm) |
| No Lead chloride added | | 1.5 |
| 1.0 | $3.6\times10^{-6}$ | 1.4 |
| 2.0 | $7.2\times10^{-6}$ | 1.5 |
| 4.0 | $1.4\times10^{-5}$ | 1.5 |

EXAMPLE 5

A series of monodisperse silver chloride emulsions were prepared by a method similar to that described in Example 2, except that the doped emulsions were prepared by adding 10 mg of either copper chloride or zinc chloride to the reaction vessel 5 minutes after the start of the precipitation. The resulting emulsions were then optimally gold chemically sensitized, coated and processed as described in Example 1. Table VI below shows the concentration of the dopants utilized and the relative speeds are shown for the copper and zinc doped emulsions at points C and D, respectively, in FIG. 1.

TABLE VI

| Metal Dopant | mg/Ag Mole | Moles/Ag Mole | Emulsion Grain Size (μm) |
|---|---|---|---|
| None | — | — | 1.5 |
| $CuCl_2$ | 2.0 | $1.5\times10^{-5}$ | 1.6 |
| $ZnCl_2$ | 2.0 | $1.47\times10^{-5}$ | 1.5 |

A. A silver chlorobromide emulsion (20 mole percent bromide) lacking an internal metal dopant was prepared in the following manner:

Three solutions were prepared as follows:

| | |
|---|---|
| **Solution 1 (Placed in the Reaction Vessel)** | |
| Gelatin | 100 g |
| Distilled water | 7000 ml |
| Dissolve at 40° C., Adjust pH to 2.0 | |
| **Solution 2** | |
| Sodium chloride | 367 g |
| Potassium bromide | 119 g |
| Distilled water to total volume at 40° C. | 2900 ml |
| **Solution 3** | |
| Silver nitrate | 850 g |
| Distilled water to total volume | 2900 ml |
| Dissolve at 40° C. | |

To solution 1 were added 2.5 g of a silver halide ripening agent of the type disclosed in McBride U.S. Pat. No. 3,271,157. The pAg of solution was then adjusted to 7.94 with solution 2. Solutions 2 and 3 were then simultaneously run into solution 4 over a 40 minute period using an accelerated flow technique, maintaining the pAg at 7.94. Following precipitation a pH coagulable gelatin derivative was added to the emulsion, and the emulsion was washed using the procedure described in Example 3 of Yutzy et al U.S. Pat. No. 2,614,929.

B. A cadmium doped silver chlorobromide emulsion (20 mole percent bromide), was prepared as described in paragraph A above except that 10 mg of cadmium chloride ($1.1\times10^{-5}$ mole/Ag mole) were added to the reaction vessel 5 minutes after the start of the precipitation.

C. A silver chlorobromide emulsion (50 mole percent bromide) was prepared as in Paragraph A, except that the amounts of sodium chloride and potassium bromide utilized in the preparation of solution 2 were 279 g and 298 g, respectively.

D. A cadmium doped silver chlorobromide emulsion (50 mole percent bromide) was prepared as described in Paragraph C, except that the 10 mg of cadmium chloride ($1.1\times10^{-5}$ mole/Ag mole) were added to the reaction vessel 5 minutes after the start of precipitation.

E. The silver chlorobromide emulsions prepared in Paragraphs A-D were optimally gold chemically sensitized, coated and processed as described in Example 1. Table VII shows the fog levels.

TABLE VII

| AgCLBr (mole % Br) | Cadmium Dopant mg/Ag Mole | Cadmium Dopant Mole/Ag Mole | Emulsion Grain Size (μm) |
|---|---|---|---|
| 20 | None | None | 1.0 |
| 20 | 2.0 | $1.1\times10^{-5}$ | 1.0 |
| 50 | None | None | 0.8 |
| 50 | 2.0 | $1.1\times10^{-5}$ | 0.8 |

Figure 2:
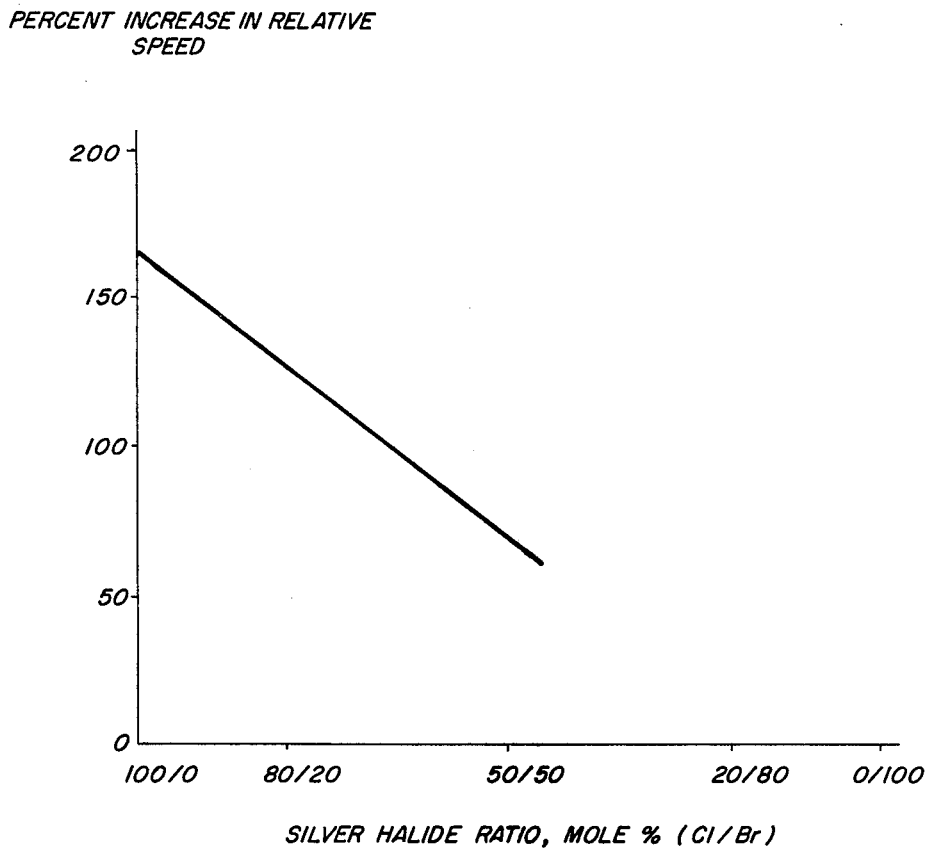

In FIG. 2 a plot is provided of the increase in relative speed versus the halide content. The increase in relative speed is obtained by taking the relative speed of a photographic element formed with an undoped, surface chemically sensitized emulsion as 100 and plotting as an ordinate the additional speed of an otherwise identical element formed with an emulsion differing by containing a dopant, as described above. The abscissa is plotted in terms of mole percent, the mole percent chloride in the silver halide emulsion being the numerator and the mole percent bromide in the silver halide emulsion being the denominator.

EXAMPLE 7

Figure 3:
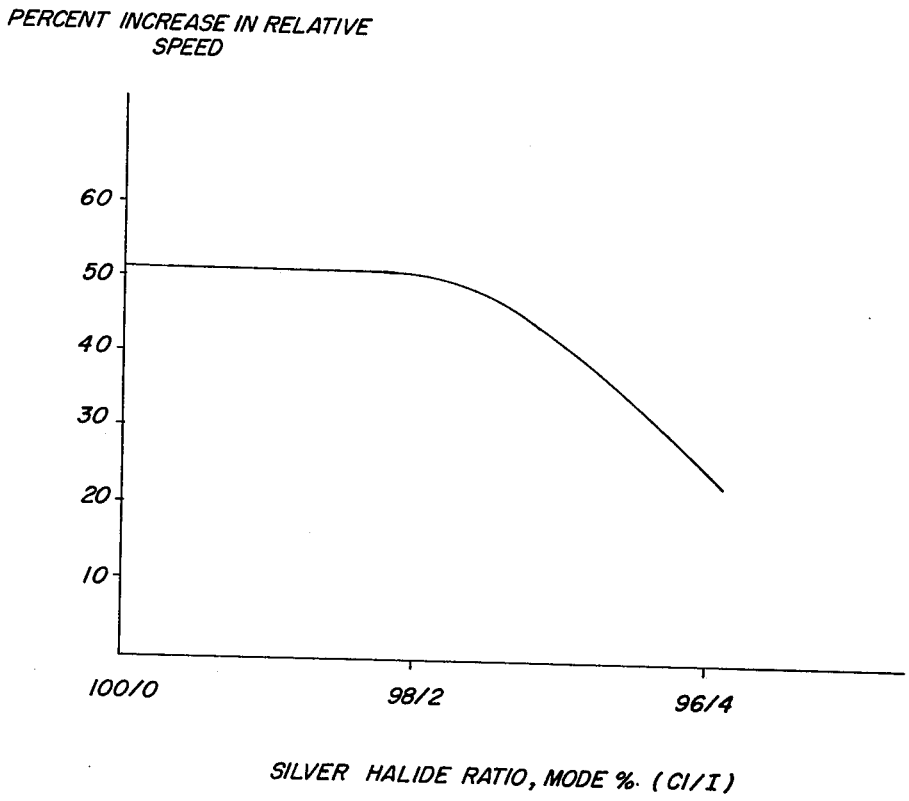

A series of six monodisperse silver chloroiodide emulsions (0.7 μm), were prepared in a manner similar to Example 2 except that a constant flow technique was utilized rather than an accelerated flow and the precipitation was carried out at a temperature of 60° C. The emulsion series contains two silver chloroiodide emulsions (undoped and doped with 2 mg/Ag mole of cadmium chloride) at each of three separate chloride/iodide ratios, 100/0, 98/2 and 96/4. The emulsions having these chloride/iodide ratios were prepared by adding either 0, 16.6 or 33.2 g of potassium iodide, respectively, to solution 2 prior to precipitation. The resulting emulsions were coated, exposed and processed by the method described in Example 1. In FIG. 3 a plot is provided of the increase in relative speed achieved by doping versus the halide ratio.

EXAMPLE 8

Two incorporated coupler color print materials were prepared in the same manner, except differing in the emulsions utilized in the blue-sensitive, yellow dye-forming layer. The multilayer coatings were prepared in the following manner:

Separate portions of a polyethylene coated paper support were coated with gelatin layers comprising the yellow dye-forming coupler α-[4-(4-benzyloxyphenylsulfonyl)-phenoxy]-α-pivalyl-2-chloro-5-[γ-butyramido]-acetanilide at a coverage of 1.07 g/m$^2$ and optimally gold chemically sensitized silver chloride emulsions prepared as described in Example 2 at a coverage of 0.33 g Ag/m$^2$. The silver chloride emulsions were both spectrally sensitized to the blue region of the visible spectrum using a blue spectral sensitizer. The rest of the multilayer coating for each of the above variations are common and are described as a gelatin interlayer comprising gelatin and an antistain agent; a magenta dye-forming layer comprising a green-sensitized silver chloride emulsion, a magenta dye-forming coupler and gelatin; an interlayer comprising gelatin, an antistain agent and a UV absorber; a cyan dye-forming layer comprising a red sensitized silver chloride emulsion, a cyan dye-forming coupler and gelatin and a protective overcoat layer comprising gelatin. The multilayer photosensitive elements were then exposed to a tungsten light source through a graduated density step wedge and processed in a 3-solution color process of the type described in Edens et al U.S. Pat. No. Re. 28,112. The relative blue sensitivities of the two processed materials are shown in Table VIII.

TABLE VIII

| Emulsion in Blue-Sensitive, Yellow Dye-Forming Layer | Cadmium Chloride Dopant | Relative Blue Sensitivity |
|---|---|---|
| AgCl | None | 100 |
| AgCl | 2 mg/Ag Mole | 182 |

EXAMPLE 9

Two multicolor negative image-forming elements suitable for use in a color image transfer process, wherein color prints are obtained through the use of color negatives, were prepared. The elements were identical, except for the emulsions utilized in the blue sensitized, yellow dye-releasing unit. The elements were prepared as described below. The quantities of components are stated as grams/meter$^2$ in parenthesis. Silver halide quantities are given in terms of silver.

A poly(ethylene terephthalate) film support coated on one side with a carbon-pigmented gelatin layer was coated on the other side with the following layers:

(1) a cyan dye-providing layer comprising a dispersion of a cyan redox dye-releaser and gelatin;
(2) a light-sensitive layer comprising a red sensitized, chemically sensitized silver chloride emulsion;
(3) interlayer comprising gelatin and an antistain agent;
(4) magenta dye-providing layer comprising a dispersion of a magenta redox dye-releaser and gelatin;
(5) a light-sensitive layer comprising a green sensitized, chemically sensitized silver chloride emulsion and gelatin;
(6) interlayer comprising gelatin and an antistain agent;
(7) a yellow dye-providing layer comprising a dispersion of Compound A* (a yellow redox dye-releaser) (0.49) and gelatin (1.07);

Separate samples of the above-described element were then overcoated with layers comprising gelatin (1.07) and chemically sensitized silver chloride (0.30) emulsions prepared either as described in Control 4 or as in Example 1. The silver chloride emulsions were both spectrally sensitized to the blue region of the visible spectrum using a blue spectral sensitizer. Each sample was provided with a gelatin overcoat layer.

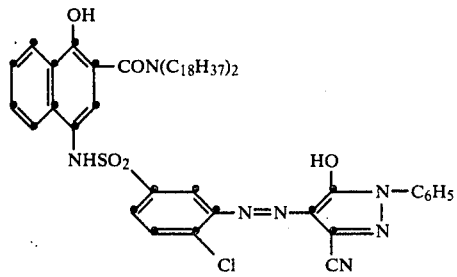

Samples of each element were identically exposed to blue light through a graduated density test object and processed as follows:

The exposed elements were soaked for 10 seconds at 28° C. in an activator solution comprising water to 1000 ml, benzyl alcohol (10 ml), 5-methylbenzotriazole (1 g), 11-aminoundecanoic acid (2 g) and 6-aminohexanoic acid, laminated to a receiving element (described below) for 2½ minutes at 24° C., and then peeled apart. The transferred yellow dye images produced in the receiving element were evaluated and the results are shown below in Table IX.

TABLE IX

| Emulsion in Blue-Sensitive Layer | Cadmium Chloride Dopant | Relative Blue Sensitivity |
|---|---|---|
| AgCl | None | 100 |
| AgCl | 2 mg/Ag Mole | 162 |

Receiving Element

The receiving element utilized comprised a paper support overcoated with a white-pigmented polyethylene layer, an acid layer comprising co-poly(styrene-maleic anhydride), a polymeric timing layer, a receiving layer comprising gelatin, 4-hydroxymethyl-4-methyl-1-phenyl-3-pyrazolidone, poly(N-vinylimidazole-co-3-hydroxyethyl-1-vinylimidazolium chloride) (90:10 weight ratio) and a gelatin overcoat layer.

EXAMPLE 10

10A. A cadmium and mercury doped silver chloride emulsion (0.6 μm, monodisperse) was prepared in a manner similar to the cadmium doped emulsion prepared in Example 2B, except the precipation was carried out in 15 minutes at a temperature of 71° C. using a constant flow technique rather than an accelerated flow, the silver nitrate solution contained 0.08 mg/Ag mole of $HgCl_2$ ($2.9\times10^{-7}$ mole Hg/Ag mole), and the cadmium chloride ($1.1\times10^{-5}$ mole/Ag mole) was added to the reaction vessel over a period of eight minutes beginning at four minutes after the start of precipitation.

10B. A cadmium, mercury, iridium and rhodium doped silver chloride emulsion (0.6 μm, monodisperse) was prepared as described above (10A), except $3\times10^{-3}$ mg/Ag mole of $(NH_4)_3RhCl_6$ ($8.25\times10^{-9}$ mole Rh/Ag mole) was added over a one minute period beginning at two minutes after the start of the precipitation and $6.0\times10^{-2}$ mg/Ag mole of $K_3IrCl_6$ ($1.15\times10^{-7}$ mole Ir/Ag mole) was added at 14 minutes after the start of the precipitation.

10C. The monodisperse, doped silver chloride emulsions 10A and 10B prepared as described above were optimally gold sensitized and then spectrally sensitized with a red spectral sensitizing dye. Monochrome coatings, differing only in the silver chloride emulsion utilized, were then prepared in the following manner:

Separate portions of a polyethylene coated paper support were coated with a gelatin layer comprising the chemically and spectrally sensitized samples of emulsions 10A or 10B, at a coverage of 0.14 g Ag/m² and the cyan dye-forming coupler 2-[α-(2,4-di-tert-amylphenoxy)-butyramido]-4,6-dichloro-5-methylphenol at a coverage of 0.48 g/m². A protective gelatin overcoat layer was also applied to both coated elements.

Separate samples of the resulting elements were exposed to a tungsten light source through a graduated density step wedge at two different exposure times, 1/5" and 24". The 24" exposure was filtered to provide the same amount of total exposure as the 1/5" exposure. The difference in photographic response to the "equivalent" exposures is a measure of the reciprocity characteristics of the silver halide material. Following exposure, the photographic elements were identically processed in a three solution color process of the type described in Edens et al U.S. Pat. No. Re. 28,112. The improvement in reciprocity characteristics shown by the change in red sensitivity, as a function of exposure time of the two processed materials, is shown in Table X.

TABLE X

| Emulsion | Red Sensitivity (Relative Speed) 1/5 Second | 24 Second |
|---|---|---|
| 10A | 100 | 62 |
| 10B | 100 | 89 |

From Table X it is apparent that the low intensity reciprocity failure of the iridium doped emulsion was reduced as compared to the emulsion lacking an iridium dopant.

Characteristic curves were plotted for emulsions 10A and 10B. As compared to emulsion 10A, emulsion 10B exhibited a higher contrast over the linear portion of the characteristic curve; however, no loss in exposure latitude was observed, since the emulsion 10B exhibited a somewhat lower contrast in the shoulder region of the characteristic curve. Thus, emulsion 10B exhibited the advantage of higher contrast without loss of exposure latitude.

The invention has been described in detail with particular reference to preferred embodiments thereof, but it will be understood that variations and modifications can be effected within the spirit and scope of the invention.

What is claimed is:

1. A negative-working silver halide emulsion of the developing out type comprised of silver halide grains which are capable of producing surface latent image sites and which are at least 80 mole percent silver chloride and less than 5 mole percent silver iodide, based on total silver halide, said silver halide grains being internally doped with cadmium, lead, copper, zinc, or mixtures thereof in a speed increasing amount of up to $7\times10^{-5}$ mole per mole of silver halide.

2. A negative working silver halide emulsion of the developing out type according to claim 1, said silver halide grains being formed in the presence of cadmium, lead, copper, zinc, or mixtures thereof in a concentration of $2\times10^{-6}$ to $7\times10^{-5}$ mole per mole of silver halide and said silver halide grains being surface chemically sensitized.

3. A silver halide emulsion according to claim 1 in which said silver halide grains consist essentially of silver chloride.

4. A silver halide emulsion according to claim 1, 2, or 3, in which said silver halide grains are formed in the presence of cadmium, zinc, or mixtures thereof in a concentration of from $3\times10^{-6}$ to $6\times10^{-5}$ mole per mole of silver halide.

5. A silver halide emulsion according to claim 1, 2, or 3, in which said silver halide grains are formed in the presence of lead, copper, or mixtures thereof in a concentration of from $3\times10^{-6}$ to $5\times10^{-5}$ mole per mole of silver halide.

6. A silver halide emulsion according to claim 1, 2, or 3, in which said silver halide grains are substantially monodisperse.

7. A silver halide emulsion according to claim 1, 2, or 3, in which said silver halide grains are gold sensitized.

8. A silver halide emulsion according to claim 1, 2, or 3, in which said silver halide grains are sulfur and gold sensitized.

9. A silver halide emulsion according to claim 1, 2, or 3, in which said emulsion contains mercury as an antifoggant in a concentration of less than $10^{-6}$ mole per mole of silver.

10. A silver halide emulsion according to claim 1, 2, or 3, in which said silver halide grains are internally doped with iridium in an amount sufficient to reduce low intensity reciprocity failure.

11. A silver halide emulsion according to claim 1, 2, or 3, in which said emulsion contains a contrast increasing amount of rhodium.

12. In a photographic element of the developing out type comprised of a support and, coated on said support, a negative-working silver halide emulsion layer, the improvement comprising said silver halide emulsion layer being comprised of silver halide grains which are capable of producing surface latent image sites and which are at least 80 mole percent silver chloride and less than 5 mole percent silver iodide, based on total silver halide, said silver halide grains being internally doped with cadmium, lead, copper, zinc, or mixtures thereof in a speed increasing amount of up to $7\times10^{-5}$ mole per mole of silver halide.

13. In a photographic element according to claim 12 the further improvement comprising said silver halide grains being formed in the presence of cadmium, lead, copper, zinc, or mixtures thereof, in a concentration of from $2\times10^{-6}$ to $7\times10^{-5}$ mole per mole of silver halide and said silver halide grains being surface chemically sensitized.

14. In a photographic element according to claim 12 the further improvement comprising said silver halide layer being comprised of gold sensitized silver halide grains formed in the presence of cadmium in a concentration of from $2\times10^{-6}$ to $7\times10^{-5}$ mole per mole of silver halide.

15. In a photographic element according to claim 12, the further improvement comprising said silver halide emulsion layer being comprised of gold sensitized silver halide grains formed in the presence of zinc in a concentration of from $2\times10^{-6}$ to $7\times10^{-5}$ mole per mole of silver halide, said silver halide grains as formed being capable of producing surface latent image sites.

16. In a photographic element according to claim 14 or 15 the further improvement in which said silver halide grains are formed in the presence of from $5\times10^{-6}$ to $2.5\times10^{-5}$ mole zinc or cadmium per mole of silver halide.

17. In a photographic element according to claim 12 the further improvement comprising said silver halide emulsion layer being comprised of gold sensitized silver halide grains formed in the presense of lead in a concentration of from $2\times10^{-6}$ to $7\times10^{-5}$ mole per mole of silver halide, said silver halide grains as formed being capable of producing surface latent image sites.

18. In a photographic element according to claim 12 the further improvement comprising said silver halide emulsion layer being comprised of gold sensitized silver halide grains formed in the presence of copper in a concentration of from $2\times10^{-6}$ to $7\times10^{-5}$ mole per mole of silver halide, said silver halide grains as formed being capable of producing surface latent image sites.

19. In a photographic element according to claim 14, 15, 17, or 18 the further improvement in which said silver halide grains are formed in the presence of from $8\times10^{-6}$ to $2\times10^{-5}$ mole lead or copper per mole of silver halide.

20. In a photographic element according to claim 14, 15, 17, or 18 the further improvement in which said support is a transparent film support or a reflective paper support.

21. In a photographic element according to claim 14, 15, 17, or 18, in which said silver halide grains are internally doped with iridium in a concentration of from $10^{-8}$ to $10^{-5}$ mole per mole of silver.

22. In a photographic element according to claim 21, in which said silver halide grains are internally doped with rhodium in a concentration of from $4\times10^{-12}$ to $1\times10^{-7}$ mole per mole of silver.

23. In a photographic element according to claim 22, in which said silver halide grains are internally doped with mercury in a concentration of less than $10^{-6}$ mole per mole of silver.

24. In a photographic element of the developing out type capable of producing multicolor dye images comprised of a support and, coated on said support, at least three superimposed color-forming layer units, one of said layer units containing a blue responsive negative-working silver halide emulsion and a yellow image dye providing means, a second of said layer units containing a green responsive negative-working silver halide emulsion and a magenta image dye providing means and a third of said layer units containing a red responsive negative-working silver halide emulsion and a cyan image dye providing means, the improvement comprising at least one of said silver halide emulsions being comprised of surface chemically sensitized silver halide grains which are at least 80 mole percent silver chloride and less than 5 mole percent iodide, based on total silver halide, said silver halide grains being internally doped with cadmium, lead, copper, zinc, or mixtures thereof, in a speed increasing amount of up to $7\times10^{-5}$ mole per mole of silver halide.

25. In a photographic element capable of forming a multicolor dye image according to claim 24 the further improvement in which the photographic element forms a part of a multicolor image transfer system.

26. In a photographic element capable of forming a multicolor dye image according to claim 24 or 25 the further improvement in which said silver halide emulsions consist essentially of silver chloride.

27. In a photographic element of the developing out type capable of producing multicolor dye images comprised of a support and, coated on said support, at least three superimposed color-forming layer units, one of said layer units containing a blue responsive negative-working silver halide emulsion and a yellow image dye providing means, a second of said layer units containing a green responsive negative-working silver halide emulsion and a magenta image dye providing means and a third of said layer units containing a red responsive negative-working silver halide emulsion and a cyan image dye providing means, the improvement comprising each of said silver halide emulsions being comprised of surface chemically sensitized silver halide grains which are at least 80 mole percent silver chloride and less than 5 mole percent iodide, based on total silver halide, said silver halide grains being internally doped with cadmium, lead, copper, zinc, or mixtures thereof, in a speed increasing amount of up to $7\times10^{-5}$ mole per mole of silver halide and with iridium in an amount sufficient to reduce variation in sensitivity as a function of differing exposure times.

28. In a process of forming a negative-working silver halide emulsion of the developing out type by reacting a water soluble silver salt with one or more water soluble halide salts in an aqueous medium containing a peptizer to form radiation-sensitive silver halide grains capable of forming surface latent image sites, the improvement comprising forming silver halide grains which are at least 80 mole percent silver chloride and less than 5 mole percent iodide, based on total silver halide, and introducing into the aqueous medium during formation of the silver halide grains cadmium, lead, copper, zinc, or mixtures thereof, in a total concentration of from $2\times10^{-6}$ to $7\times10^{-5}$ mole per mole of silver halide, thereby increasing the speed of the silver halide grains formed.

29. In a process of forming a negative-working silver halide emulsion of the developing out type by a double-jet precipitation process in which an aqueous silver salt and at least one aqueous halide salt are separately and concurrently introduced into a reaction vessel in the presence of a gelatin or gelatin derived peptizer to form radiation-sensitive silver halide grains capable of forming surface latent image sites and surface chemically sensitized silver halide grains with a gold sensitizer, the improvement comprising forming silver halide grains which are at least 90 mole percent silver chloride and less than 2 mole percent silver iodide, based on total silver halide, and introducing into the reaction vessel after silver halide grain nuclei have been formed and prior to introduction of at least 85 percent of the aqueous silver salt from $3\times10^{-6}$ to $6\times10^{-5}$ mole cadmium per mole of silver halide in the form of a water soluble cadmium salt, thereby increasing the speed of the silver halide grains formed.

30. In a process of forming a negative-working silver halide emulsion of the developing out type by a double-jet precipitation process in which an aqueous silver salt and at least one aqueous halide salt are separately and concurrently introduced into a reaction vessel in the presence of a gelatin or gelatin derived peptizer to form radiation-sensitive silver halide grains capable of forming a surface latent image and surface chemically sensitizing silver halide grains with a gold sensitizer, the improvement comprising forming silver halide grains which are at least 90 mole percent silver chloride and less than 2 mole percent silver iodide, based on total silver halide, and introducing into the reaction vessel after silver halide grain nuclei have been formed and prior to introduction of at least 85 mole percent of the aqueous silver salt from $3\times10^{-6}$ to $6\times10^{-5}$ mole zinc per mole of silver halide in the form of a water soluble zinc salt, thereby increasing the speed of the silver halide grains formed.

31. In a process of forming a negative-working silver halide emulsion of the developing out type by a double-jet precipitation process in which an aqueous silver salt and at least one aqueous halide salt are separately and concurrently introduced into a reaction vessel in the presence of a gelatin or gelatin derived peptizer to form radiation-sensitive silver halide grains capable of forming a surface latent image and surface chemically sensitizing silver halide grains with a gold sensitizer, the improvement comprising forming silver halide grains which are at least 90 mole percent silver chloride and less than 2 mole percent silver iodide, based on total silver halide, and introducing into the reaction vessel after silver halide grain nuclei have been formed and prior to introduction of at least 85 mole percent of the aqueous silver salt from $3\times10^{-6}$ to $5\times10^{-5}$ mole lead per mole of silver halide in the form of a water soluble lead salt, thereby increasing the speed of the silver halide grains formed.

32. In a process of forming a negative-working silver halide emulsion of the developing out type by a double-jet precipitation process in which an aqueous silver salt and at least one aqueous halide salt are separately and concurrently introduced into a reaction vessel in the presence of a gelatin or gelatin derived peptizer to form radiation-sensitive silver halide grains capable of forming a surface latent image and surface chemically sensitizing silver halide grains with a gold sensitizer, the improvement comprising forming silver halide grains which are at least 90 mole percent silver chloride and less than 2 mole percent silver iodide, based on total silver halide, and introducing into the reaction vessel after silver halide grain nuclei have been formed and prior to introduction of at least 85 mole percent of the aqueous silver salt from $3\times10^{-6}$ to $5\times10^{-5}$ mole copper per mole of silver halide in the form of a water soluble copper salt, thereby increasing the speed of the silver halide grains formed.

33. In a process according to claim 28, 29, 30, 31, or 32 the further improvement in which silver halide grains are formed which consist essentially of silver chloride.

34. In a process according to claim 28, 29, 30, 31, or 32 the further improvement in which a thioether or thiocyanate ripening agent is present during formation of the silver halide grains.

35. In a process according to claim 28, 29, 30, 31, or 32 the further improvement in which the rates of addition of the water soluble silver and halide salts are controlled to produce a monodispersed silver halide emulsion.

* * * * *